US007696856B2

(12) United States Patent
Saito et al.

(10) Patent No.: US 7,696,856 B2
(45) Date of Patent: Apr. 13, 2010

(54) VARISTOR ELEMENT

(75) Inventors: Yo Saito, Tokyo (JP); Hitoshi Tanaka, Tokyo (JP); Makoto Numata, Tokyo (JP); Hiroyuki Sato, Tokyo (JP); Goro Takeuchi, Tokyo (JP)

(73) Assignee: TDK Corporation, Tokyo (JP)

( * ) Notice: Subject to any disclaimer, the term of this patent is extended or adjusted under 35 U.S.C. 154(b) by 677 days.

(21) Appl. No.: 11/709,677

(22) Filed: Feb. 23, 2007

(65) Prior Publication Data

US 2008/0068124 A1 Mar. 20, 2008

(30) Foreign Application Priority Data

Mar. 20, 2006 (JP) ..... 2006-077106
Feb. 1, 2007 (JP) ..... 2007-023456
Feb. 1, 2007 (JP) ..... 2007-023466

(51) Int. Cl.
*H01C 7/10* (2006.01)

(52) U.S. Cl. ..... 338/20; 338/309; 338/328; 361/306.3

(58) Field of Classification Search ..... 338/20, 338/21, 22 R, 307–309, 328, 331; 361/127, 361/306.3, 309

See application file for complete search history.

(56) References Cited

U.S. PATENT DOCUMENTS 5,412,357 A * 5/1995 Nakamura et al. ..... 333/181
6,087,923 A * 7/2000 Ahn et al. ..... 338/21
6,184,769 B1 * 2/2001 Nakamura et al. ..... 338/21
6,717,506 B2 * 4/2004 Ishii ..... 338/22 R

FOREIGN PATENT DOCUMENTS

JP 2001-15815 1/2001

* cited by examiner

*Primary Examiner*—Kyung Lee
(74) *Attorney, Agent, or Firm*—Oliff & Berridge, PLC

(57) ABSTRACT

A laminated chip varistor comprises a varistor body, first and second inner electrodes, a heat conductor, and first and second outer electrodes. The varistor body has first and second outer faces. The first and second inner electrodes are disposed in the varistor body so that at least portions thereof are opposing to each other. The first and second outer electrodes are formed on the first outer face, the first outer electrode being connected to the first inner electrode, and the second outer electrode being connected to the second inner electrode. The heat conductor is formed in the varistor body extending in a direction from the first outer face toward the second outer face with one end face thereof exposed on the first outer face and the other end face thereof exposed on the second outer face.

15 Claims, 37 Drawing Sheets

(a)

(b)

(a)

(b)

(a)

(b)

(a)

(b)

(a)

(b)

(a)

(b)

(a)

(b)

(a)

(b)

(a)

(b)

(a)

(b)

VARISTOR ELEMENT

BACKGROUND OF THE INVENTION

1. Field of the Invention

The present invention relates to a varistor element.

2. Description of the Related Art

Conventionally disclosed light emitting devices comprise an electronic element and a varistor element electrically connected to the electronic element (for example, see Japanese Laid-open Patent Application No. 2001-15815). In the light emitting device described in Japanese Laid-open Patent Application No. 2001-15815, the varistor element is connected in parallel with a semiconductor light-emitting element serving as the electronic element, the semiconductor light emitting element being protected from ESD (Electro Static Discharge) surges by the varistor.

SUMMARY OF THE INVENTION

Heat is emitted during the operation of electronic elements such as a semiconductor light emitting element or FET (Field Effect Transistor) or the like. Deterioration of the electronic element itself occurs when the electronic element reaches a high temperature, the effect of which is reflected in the operation thereof. Accordingly, this generated heat needs to be efficiently dissipated.

It is an object of the present invention to provide a varistor element that can efficiently dissipate heat.

The varistor element pertaining to the present invention comprises a varistor body having first and second outer faces, first and second inner electrodes disposed in the varistor body so that at least portions thereof are opposing to each other, a first outer electrode electrically connected to the first inner electrode and formed on the first outer face, and a second outer electrode electrically connected to the second inner electrode and formed on the first outer face, wherein a heat-conducting passage is formed through the varistor body from the first outer face toward the second outer face.

In the varistor element pertaining to the present invention, a heat-conducting passage is formed through the varistor body from the first outer face toward the second outer face. For this reason, when an electronic element such as a semiconductor light emitting element or FET or the like from which heat is emitted during the operation thereof is disposed on the first outer face of the varistor body, the heat generated by the electronic element is transferred to the second outer face of the varistor body by way of the heat-conducting passage. As a result, the heat can be efficiently dissipated from the first outer face toward the second outer face of the varistor element.

In addition, it is preferable that the heat-conducting passage extends in parallel with the first and second inner electrodes. In this arrangement, obstruction to the heat conduction of the heat-conducting passage by the inner electrodes is unlikely and, accordingly, the heat can be more efficiently dissipated.

In addition, it is preferable that the first outer face and the second outer face are opposing to each other, and that the heat-conducting passage extends in an opposing direction of the first and second outer faces. In this arrangement, the heat-conducting passage is substantially linear in shape and, accordingly, the heat-conducting passage is more easily formed.

In addition, it is preferable that the heat-conducting passage contains at least a heat conductor having a thermal conductivity higher than a thermal conductivity of the varistor body. In this arrangement, the heat can be more efficiently dissipated by the heat conductor contained in the heat-conducting passage.

In addition, it is preferable that one end of the heat conductor is exposed on the first outer face, and the other end thereof be exposed on the second outer face. In this arrangement, each of the two ends of the heat conductor is exposed on outer faces and, accordingly, the heat from the electronic element is more easily transferred to the heat conductor and, in turn, the heat can be more efficiently dissipated. More particularly, when one end of the heat conductor exposed on the first outer face is physically and thermally connected to the electronic element by a bump electrode or the like, the heat generated by the electronic element is directly transferred to the heat conductor by way of the bump electrode or the like and, in turn, the heat dissipating characteristics are further improved.

In addition, it is preferable that the heat conductor is configured from a material the same as the material of the first and second inner electrodes. In this arrangement, because the heat conductor can be formed in the same step as the first and second inner electrodes, the steps for manufacturing the varistor body can be simplified.

A varistor element pertaining to the present invention comprises a varistor body having first and second outer faces, first and second inner electrodes disposed in the varistor body so that at least portions thereof are opposing to each other, a first outer electrode electrically connected to the first inner electrode and formed on the first outer face, a second outer electrode electrically connected to the second inner electrode and formed on the first outer face, a heat conductor which is disposed through the varistor body from the first outer face toward the second outer face and one end of which is exposed on the first outer face, and an insulating film disposed on the first outer face to cover at least one end of the heat conductor exposed on the first outer face.

In the varistor element pertaining to the present invention, the heat conductor is disposed in the interior of the varistor body from the first outer face toward the second outer face. For this reason, when an electronic element such as a semiconductor light emitting element or FET from which heat is emitted during the operation thereof is disposed on the first outer face of the varistor body, the heat generated by the electronic element is transferred to the second outer face of the varistor body by way of the heat-conducting passage. As a result, the heat can be efficiently dissipated from the first outer face to the second outer face of the varistor element.

In addition, it is preferable that the heat conductor extends in parallel with the first and second inner electrodes. In this arrangement, obstruction to the heat conduction of the heat conductor by the inner electrodes is unlikely and, accordingly, the heat can be more efficiently dissipated.

In addition, it is preferable that the first outer face and the second outer face are opposing to each other, and that the heat conductor extends in an opposing direction of the first and second outer faces. In this arrangement, the heat-conducting passage is substantially linear in shape and, accordingly, the heat-conducting passage is more easily formed.

In addition, it is preferable that the varistor body has an opposing first side face and second side face that extend to couple the first outer face and the second outer face, and that the heat conductor extends in an opposing direction of the first and second side faces. In this arrangement, because the heat conductor is a substantially flat-plate shape, the heat conductor is more easily formed.

In addition, it is preferable that the heat conductor has a section exposed on the first and second side faces.

In addition, it is preferable that the other end of the heat conductor be exposed on the second outer face. In this arrangement, the two ends of the heat conductor are each exposed on outer faces and, accordingly, the heat from the electronic element is more easily transferred to the heat conductor and, in turn, the heat can be more efficiently dissipated.

In addition, it is preferable that a width of the heat conductor in an opposing direction of the first and second inner electrodes is greater than a width of first and second inner electrodes in an opposing direction of the first and second inner electrodes. In this arrangement, a greater amount of heat is conducted though the heat conductor and, accordingly, the heat can be more efficiently dissipated.

In addition, it is preferable that a thermal conductivity of the heat conductor be higher than a thermal conductivity of the varistor body. In this arrangement, a greater amount of heat is conducted though the heat conductor and, accordingly, the heat can be more efficiently dissipated.

In addition, it is preferable that the heat conductor is configured from a material the same as the material of the first and second inner electrodes. In this arrangement, the heat conductor can be formed in the same step as the first and second inner electrodes and, accordingly, the steps for manufacturing the varistor body can be simplified.

According to the present invention, a varistor element that efficiently dissipates heat can be provided.

The present invention will become more fully understood from the detailed description given hereinbelow and the accompanying drawings that are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be hereinafter described with reference to the drawings. Notably, identical symbols are employed for identical elements or elements having an identical function, and replication of the description thereof has been omitted. The following embodiments refer to examples in which the present invention has application in a laminated chip varistor.

First Embodiment

Figure 1:
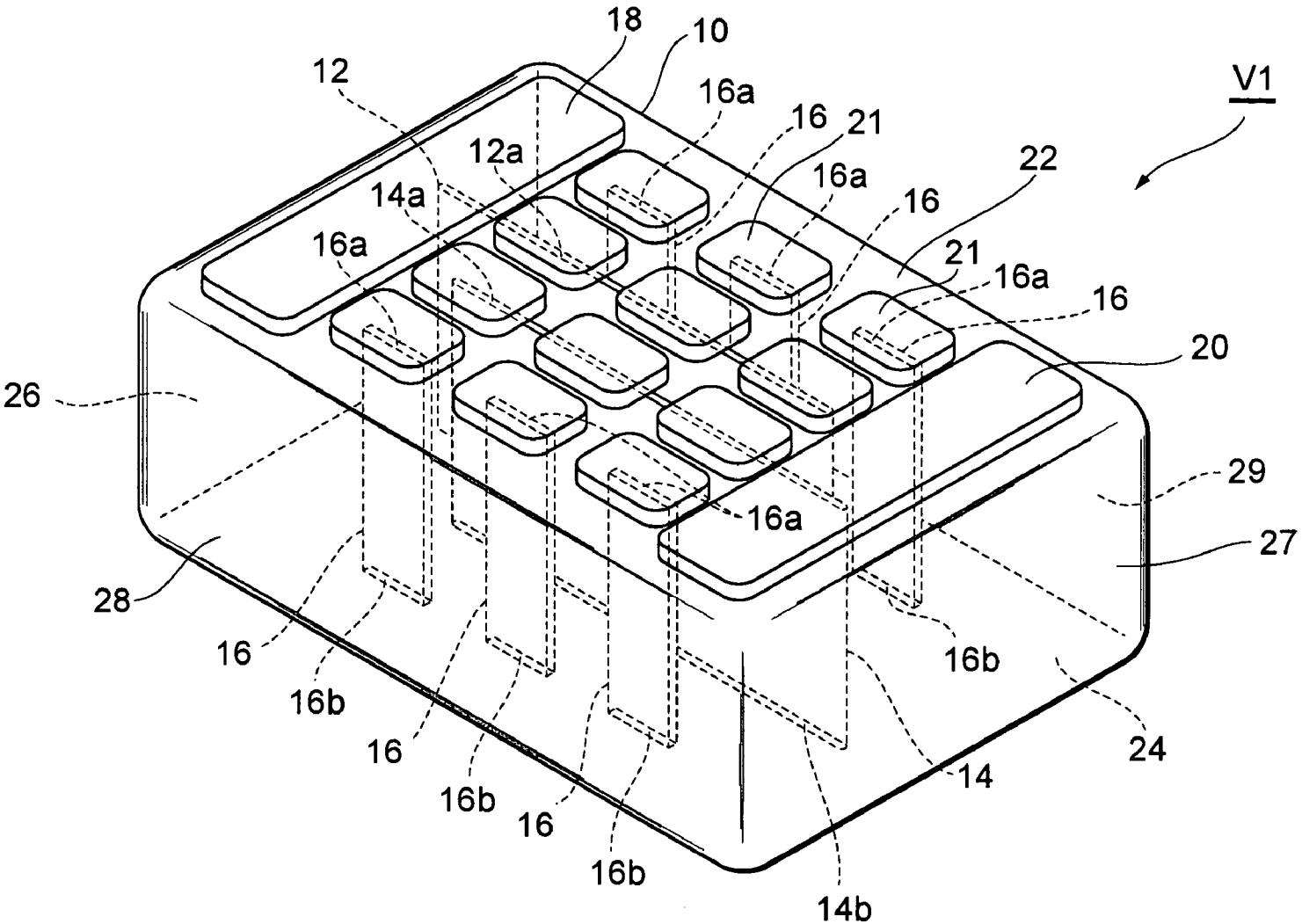
FIG. 1 is a perspective view of a laminated chip varistor pertaining to a first embodiment.
Figure 2:
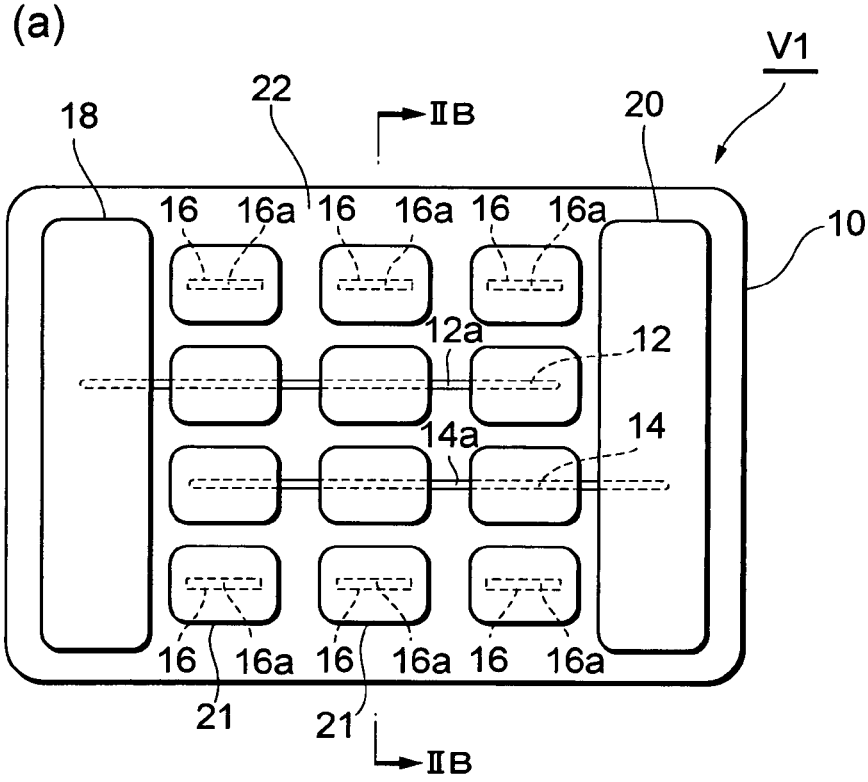
FIG. 2 is (a): a plan view of a laminated chip varistor pertaining to the first embodiment and (b): an end view along the line IIB-IIB of (a)
Figure 2:
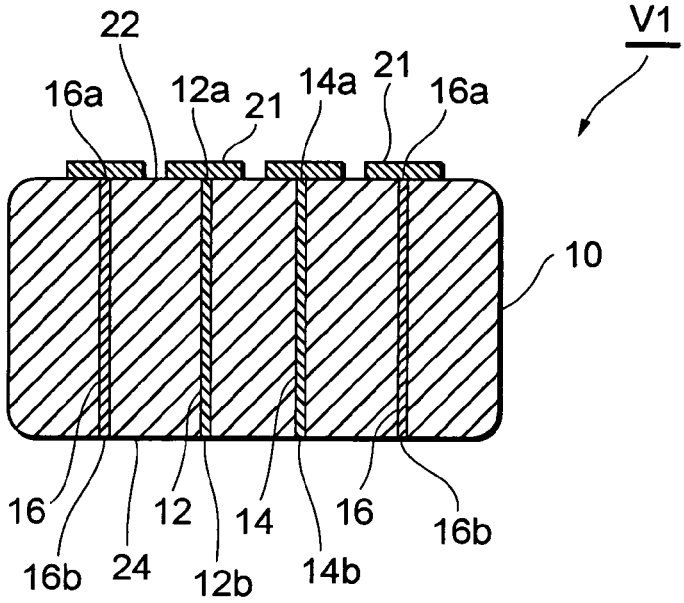
Figure 3:
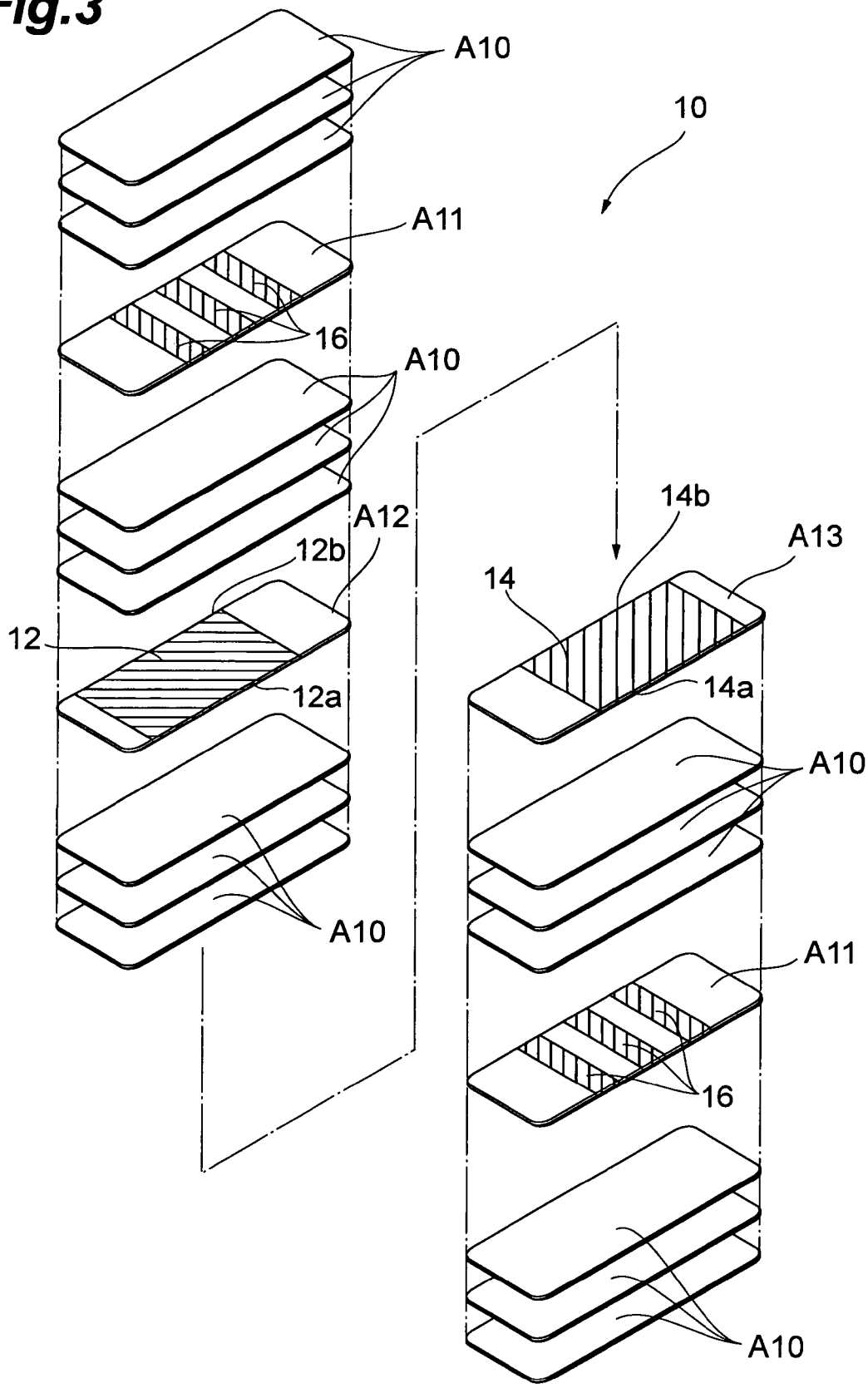
FIG. 3 is an exploded perspective view of a varistor body from which the laminated chip varistor pertaining to the first embodiment is configured.

FIG. 1 to FIG. 3 describe a configuration of a laminated chip varistor V1 pertaining to a first embodiment. FIG. 1 is a perspective view of a laminated chip varistor pertaining to the first embodiment. FIG. 2 is (a): a plan view of the laminated chip varistor pertaining to the first embodiment and (b): an end view along the line IIB-IIB of (a). FIG. 3 is an exploded perspective view of a varistor body from which the laminated chip varistor pertaining to the first embodiment is configured.

The laminated chip varistor V1 comprises a varistor body 10, a pair of first and second inner electrodes 12, 14, a plurality (six in this first embodiment) of heat conductors 16, a pair of first and second outer electrodes 18, 20, and a plurality (twelve in this first embodiment) of connecting terminals 21.

The varistor body 10 has a substantially rectangular parallelepiped shape having opposing first and second outer faces 22, 24, first and second side faces 26, 27 vertically opposing the first and second outer faces 22, 24, and third and fourth side faces 28, 29 vertically opposing the first and second outer faces 22, 24 and the first and second side faces. The varistor body 10 can be set to, for example, a length in the longitudinal direction of the order of 1.0 mm, a width of the order of 1.0 mm, and a thickness of the order of 0.3 mm.

The varistor body 10 is configured as a laminate obtained by a method of lamination based on sheet lamination of a plurality of varistor layers A10 to A13 (see FIG. 3) that exhibit nonlinear voltage characteristics (hereinafter referred to as "varistor characteristics"). The varistor layers A10 to A13 of an actual laminated chip varistor V1 are integrated to an extent that the boundaries therebetween may be ignored. The varistor layers A10 to A13 are configured from a material that contains ZnO (zinc oxide) as its principal constituent, and a metal simplex or oxide of the rare earth metal elements, Co, Group IIb elements (B, Al, Ga, In), Si, Cr, Mo, alkali metal elements (K, Rb, Cs) and alkali earth metal elements (Mg, Ca, Sr, Ba) as an accessory constituent. The thickness of each of the varistor layers A10 to A13 can be set to the order of 10 m to 100 μm.

The first and second inner electrodes 12, 14 are formed into a substantially rectangular-shaped thin plate body. End faces 12*a*, 14*a* of the first and second inner electrodes 12, 14 are drawn to the first outer face 22 to face onto the first outer face 22, and other end faces 12*b*, 14*b* thereof are drawn to the second outer face 24 to face onto the second outer face 24. That is to say, each of the end faces 12*a*, 12*b*, 14*a*, 14*b* of the first and second inner electrodes 12, 14 are exposed on the first and second outer faces 22, 24.

The first inner electrode 12 is disposed on the varistor layer A12 nearer the first side face 26 with a predetermined interval from the first side face 26 side. The second inner electrode 14 is disposed on the varistor layer A14 nearer the second side face 27 with a predetermined interval from the second side face 27 side. For this reason, as seen from the laminating direction of the varistor layers A10 to A13 (hereinafter referred to simply as the "laminating direction"), the first inner electrode 12 and the second inner electrode 14 sandwich the varistor layer A10 with portions thereof opposing to each other. Accordingly, the region of the varistor layers A10, A12 as seen from the laminating direction in which the first inner electrode 12 and the second inner electrode 14 overlap functions as a region that exhibits varistor characteristics.

The first and second inner electrodes 12, 14 contain a conductive material. While there are no particular restrictions to the conductive material contained in the first and second inner electrodes 12, 14, Ag, Pd, or an Ag—Pd alloy are preferred. The thickness adopted for the first and second inner electrodes 12, 14 may be, for example, of the order of 2 μm to 100 μm.

The heat conductors 16 are formed into a substantially rectangular-shaped thin plate body provided in the varistor body 10 in positions between the first and second inner electrodes 12, 14. The heat conductors 16 are disposed in the varistor layer A11 with a predetermined clearance from the first and second side faces 26, 27 and with a predetermined clearance that affords electrical insulation therebetween. One end face 16*a* of each heat conductor 16 is drawn to the first outer face 22 to face onto the first outer face 22, and the other end face 16*b* thereof is drawn to the second outer face 24 to face onto the second outer face 24. That is to say, the heat conductors 16 are formed in the varistor body 10 to extend in a direction from the first outer face 22 toward the second outer face 24 (opposing direction of the first outer face 22 and the second outer face 24) and to extend in parallel with the first and second inner electrodes 12, 14, the end faces 16*a*, 16*b* of the heat conductors 16 being exposed on the first and second outer faces 22, 24.

While a material of a higher thermal conductivity than the thermal conductivity of the varistor body 10 (in the first embodiment, the thermal conductivity of the ZnO which serves as the principal constituent of the varistor body 10) such as, Pd, Ag—Pd alloy or a ceramic of, for example, aluminium nitride (AlN), BN, TiN, TaC or $Si_3N_4$ can be employed as the heat conductor 16, from the viewpoint of simplification of the manufacturing process, configuring of the heat conductor 16 from a material the same as the material of the first and second inner electrodes 12, 14 is preferred. The thickness adopted for the heat conductor 16 may be of the order of, for example, 10 μm to 300 μm.

As seen from the vertical direction to the first outer face 22, the first and second outer electrodes 18, 20 have a substantially rectangular shape, each of which is formed on the first outer face 22 of the varistor body 10. While the first outer electrode 18 is physically and electrically connected with the region of the one end face 12*a* of the first inner electrode 12 exposed to the first outer face 22 nearer the first side face 26 of the varistor body 10 to cover this region, it is not physically and electrically connected with the one end face 14*a* of the second inner electrode 14 exposed on the first outer face 22. In addition, while the second outer electrode 20 is physically and electrically connected with the region of the one end face 14*a* of the second inner electrode 14 exposed to the first outer face 22 nearer the second side face 27 of the varistor body 10 to cover the region, it is not physically and electrically connected with the one end face 12*a* of the first inner electrode 12 exposed on the first outer face 22. That is to say, the first and second outer electrodes 18, 20 are physically and electrically connected with these end faces 12*a*, 14*a* of the first and second inner electrodes 12, 14 in corresponding pairs therewith.

As seen from the vertical direction to the first outer face 22, the connecting terminals 21 have a substantially square shape and are formed on the first outer face 22 of the varistor body 10 without physical connection therewith. The connecting terminals 21 cover a predetermined region of the one end face 12*a* of the first inner electrode 12 exposed on the first outer face 22, a predetermined region of the one end face 14*a* of the second inner electrode 14 exposed on the first outer face 22, and one end face 16*a* of the heat conductors 16 exposed on the first outer face 22, and are physically and thermally connected therewith.

The first and second outer electrodes 18, 20 and the connecting terminals 21 can be formed by, for example, a printing method or a plating method. If the printing method is employed, a conductive paste obtained by mixing of an organic binder and organic solvent in a metal powder of which the principal constituent is Au particles or Pt particles is prepared, this conductive paste is printed on the varistor body 10 and this printed conductive paste is baked or sintered. The plating method is based on deposition of Au or Pt using a method of vacuum plating (vacuum deposition, spluttering method, ion plating method or the like).

Figure 4:
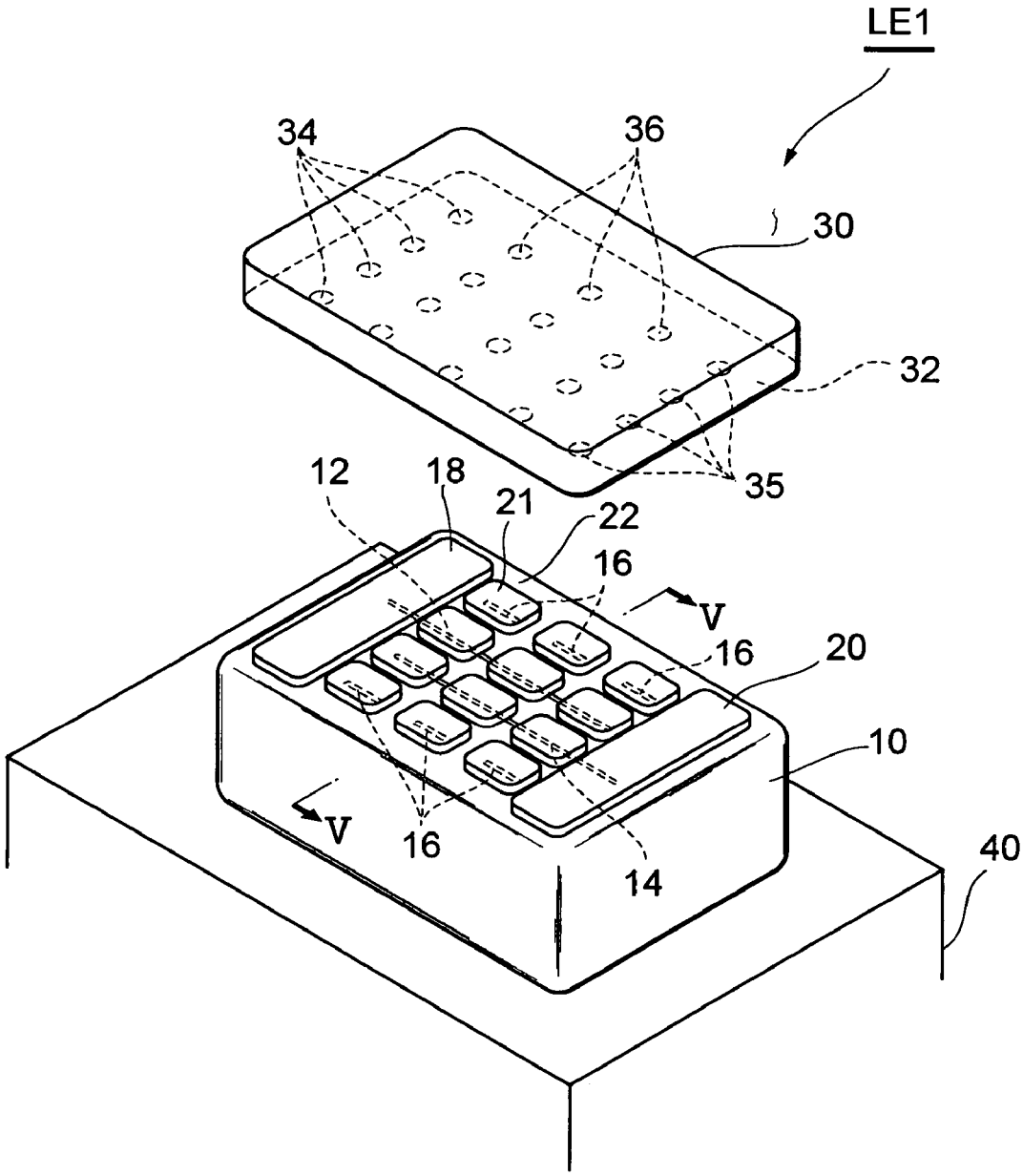
FIG. 4 is an exploded perspective view of a light emitting device in which the laminated chip varistor pertaining to the first embodiment is employed.
Figure 5:
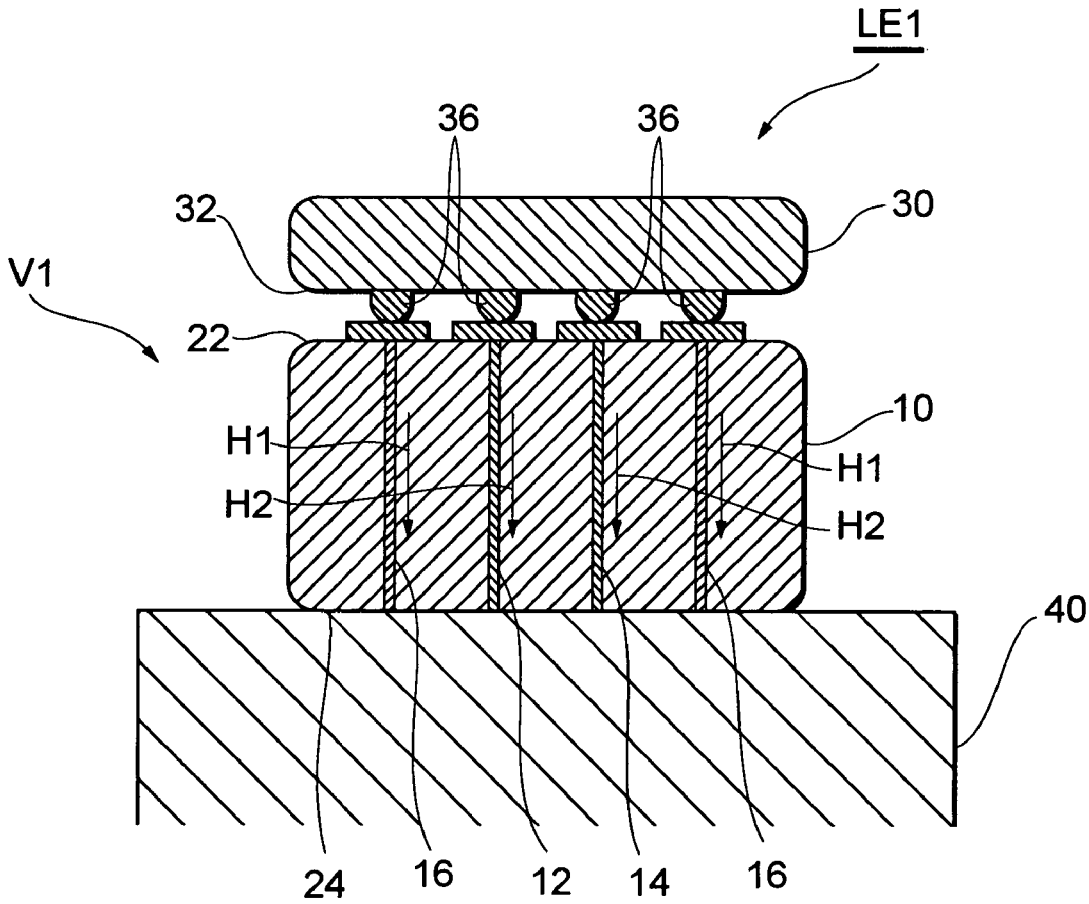
FIG. 5 is an end view along the line V-V of FIG. 4.

A light emitting device LE1 in which the laminated chip varistor V1 of the configuration described above has connection with a semiconductor light emitting element 30 will be hereinafter described with reference to FIG. 4 and FIG. 5. FIG. 4 is an exploded perspective view of a light emitting device in which the laminated chip varistor pertaining to the first embodiment is employed. FIG. 5 is a diagram of the end face along the line V-V of FIG. 4.

The light emitting device LE1 comprises the laminated chip varistor V1, the semiconductor light emitting element 30 and a substrate 40 on which the laminated chip varistor V1 is mounted.

The semiconductor light emitting element 30 is a LED (Light Emitting Diode) of, for example, a GaN (gallium nitride)-based semiconductor. The semiconductor light emitting element 30 emits light in a light emitting region subsequent to the flow of an electric current produced by a predetermined voltage applied between an anode electrode and cathode electrode not shown in the diagram.

In the semiconductor light emitting element 30, first to third bump electrodes 34 to 36 are formed in plurality in an opposing face 32 opposing the first outer face 22 of the varistor body 10 of the laminated chip varistor V1. The first bump electrodes 34 are connected with an anode electrode not shown in the diagram and disposed in a position opposing the first outer electrode 18 of the semiconductor light emitting element 30. The second bump electrodes 35 are connected with a cathode electrode not shown in the diagram and disposed in a position opposing the second outer electrode 20 of the semiconductor light emitting element 30. These first and second bump electrodes 34, 35 are physically and electrically connected to the first and second outer electrodes 18, 20 by solder reflow. Because the semiconductor light emitting element 30 is connected to the first and second outer electrodes 18, 20 by the plurality of first and second first bump electrodes 34, 35 in this way, the bonding strength between the semiconductor light emitting element 30 and the laminated chip varistor V1 is improved.

The first and second outer electrodes 18, 20 are also electrically connected to the corresponding bump electrode 34, 35. For this reason, a varistor configured from the first inner electrode 12, second inner electrode 14, and region in which the first and second inner electrodes 12, 14 overlap in the varistor layers A10, A12 is connected in parallel to the semiconductor light emitting element 30. Accordingly, the semiconductor light emitting element 30 can be protected from ESD (Electro Static Discharge) surges by the laminated chip varistor V1. The first and second outer electrodes 18, 20 of the laminated chip varistor V1 function as input/output terminal electrodes of the laminated chip varistor V1 at this time.

The bump electrodes 36 are connected to a main body section that constitutes a non-electrode section of the semiconductor light emitting element 30 and are disposed in a position to form opposing pairs with the connecting terminals 21. The bump electrodes 36 are physically and thermally connected with the connecting terminals 21 by solder reflow. For this reason, the bump electrodes 36 transfer the heat generated by the semiconductor light emitting element 30 to the first and second inner electrodes 12, 14 and heat conductors 16.

In the first embodiment described above, the heat conductors 16 are formed in the interior of the varistor body 10 extending in a direction from the first outer face 22 toward the second outer face 24 and extending in parallel with the first and second inner electrodes 12, 14. The thermal conductivity of the material of the heat conductors 16 is higher than the thermal conductivity of the varistor body 10 (in the first embodiment, thermal conductivity of ZnO which serves as the principal constituent of the varistor body 10). In addition, the one end face 16*a* of the heat conductors 16 is exposed on the first outer face 22, and the other end face 16*b* of the heat conductors 16 is exposed on the second outer face 24. For this reason, the heat generated by the semiconductor light emitting element 30 is transferred from the first outer face 22 toward the second outer face 24 along the heat conductors 16 by way of the connecting terminals 21 and bump electrodes 36 which physically and thermally connect the one end face 16*a* of the heat conductors 16 with the semiconductor light emitting element 30 (see the arrow H1 of FIG. 5). As a result, the heat of the semiconductor light emitting element 30 is able to be effectively dissipated to the substrate 40 by the laminated chip varistor V1.

Second Embodiment

Figure 6:
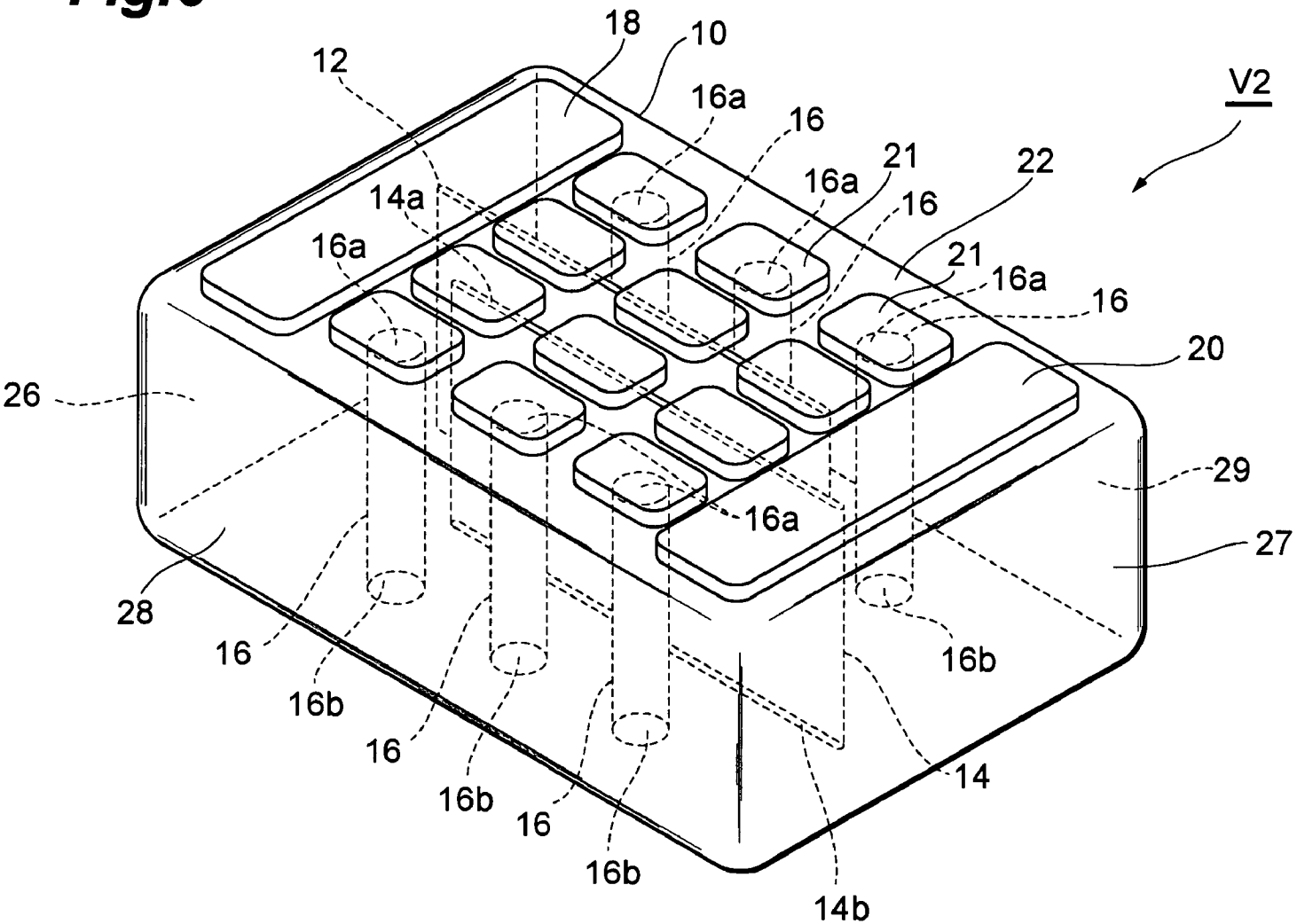
FIG. 6 is a perspective view of a laminated chip varistor pertaining to a second embodiment.
Figure 7:
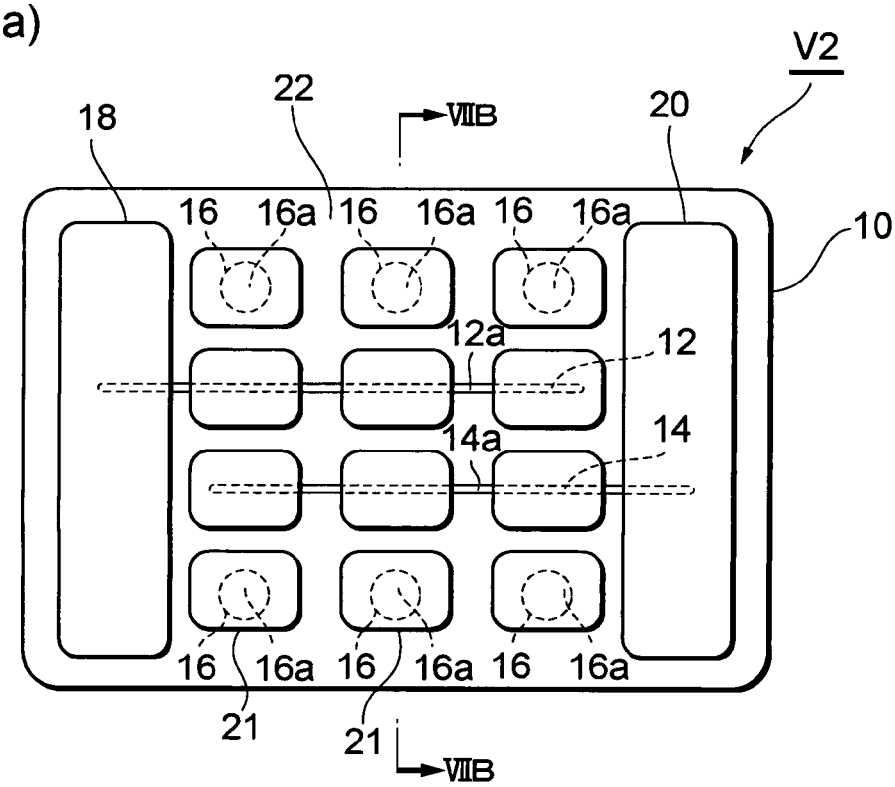
FIG. 7 is (a): a plan view of the laminated chip varistor pertaining to the second embodiment and (b): an end view along the line VIIB-VIIB of (a)
Figure 7:
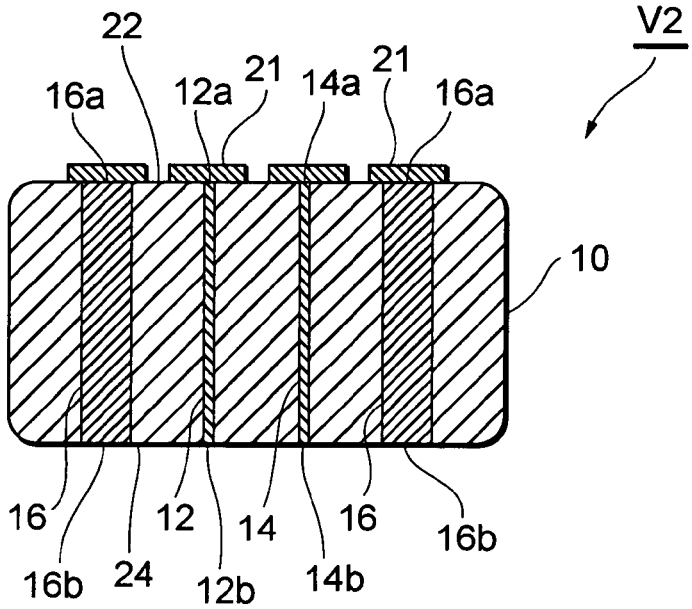

The configuration of a laminated chip varistor V2 pertaining to a second embodiment will be hereinafter described with reference to FIG. 6 and FIG. 7. FIG. 6 is a perspective view of a laminated chip varistor pertaining to the second embodiment. FIG. 7 is (a): a plan view of the laminated chip varistor pertaining to the second embodiment and (b): an end view along the line VIIB-VIIB of (a). The laminated chip varistor V2 pertaining to the second embodiment differs from the laminated chip varistor V1 pertaining to the first embodiment described above in the shape of the heat conductors 16.

There are six heat conductors 16 provided in the varistor body 10 of the laminated chip varistor V2 pertaining to the second embodiment. The heat conductors 16 have a substantially cylinder shape extending in the opposing direction of the first outer face 22 and the second outer face 24. Because, for this reason, the cross-sectional area in the direction in which the heat conductors 16 extend is larger in the laminated chip varistor V2 pertaining to the second embodiment than in the laminated chip varistor V1 pertaining to the first embodiment described above, the heat of the semiconductor light emitting element 30 can be even more efficiently dissipated.

Third Embodiment

Figure 8:
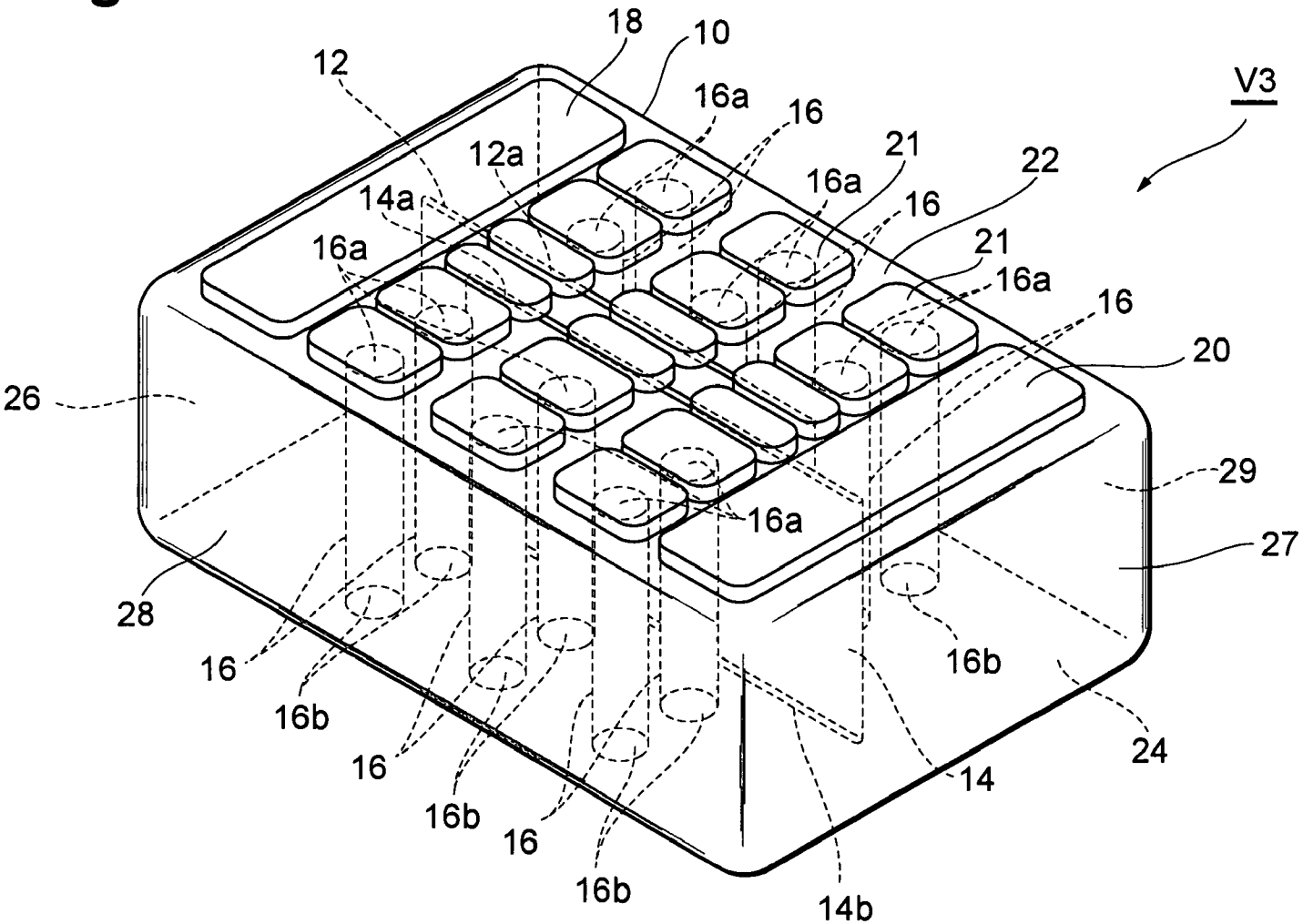
FIG. 8 is a perspective view of a laminated chip varistor pertaining to a third embodiment.
Figure 9:
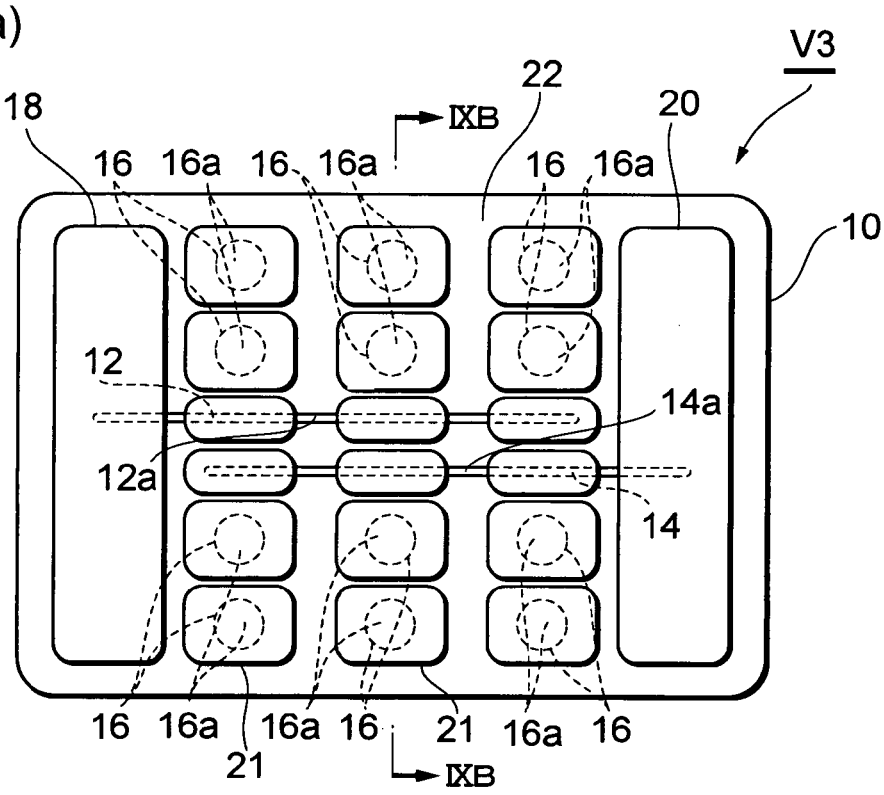
FIG. 9 is (a): a plan view of the laminated chip varistor pertaining to the third embodiment and (b): an end view along the line IXB-IXB of (a)
Figure 9:
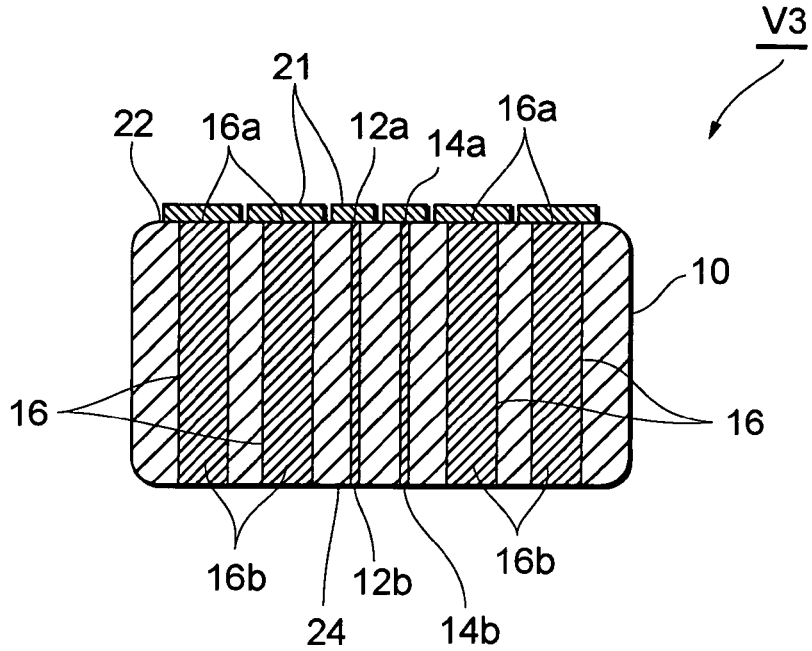

The configuration of a laminated chip varistor V3 pertaining to a third embodiment will be hereinafter described with reference to FIG. 8 and FIG. 9. FIG. 8 is a perspective view of a laminated chip varistor pertaining to the third embodiment. FIG. 9(*a*) is a plan view of the laminated chip varistor pertaining to the third embodiment and FIG. 7(*b*): an end view along the line IXB-IXB of FIG. 9(*a*). The laminated chip varistor V3 pertaining to the third embodiment differs from the laminated chip varistor V1 pertaining to the first embodiment described above in the shape of the heat conductors 16 and the number of heat conductors 16 provided.

Twelve heat conductors 16 are provided in the varistor body 10 of the laminated chip varistor V3 pertaining to the third embodiment. The heat conductors 16 have a substantially cylinder shape extending in the opposing direction of the first outer face 22 and the second outer face 24. Because, for this reason, the cross-sectional area in the direction in which the heat conductors 16 extend is larger in the laminated chip varistor V3 pertaining to the third embodiment than in the laminated chip varistor V1 pertaining to the first embodiment described above and, in addition, because the number of heat conductors 16 is greater, the heat of the semiconductor light emitting element 30 can be even more efficiently dissipated.

Fourth Embodiment

Figure 10:
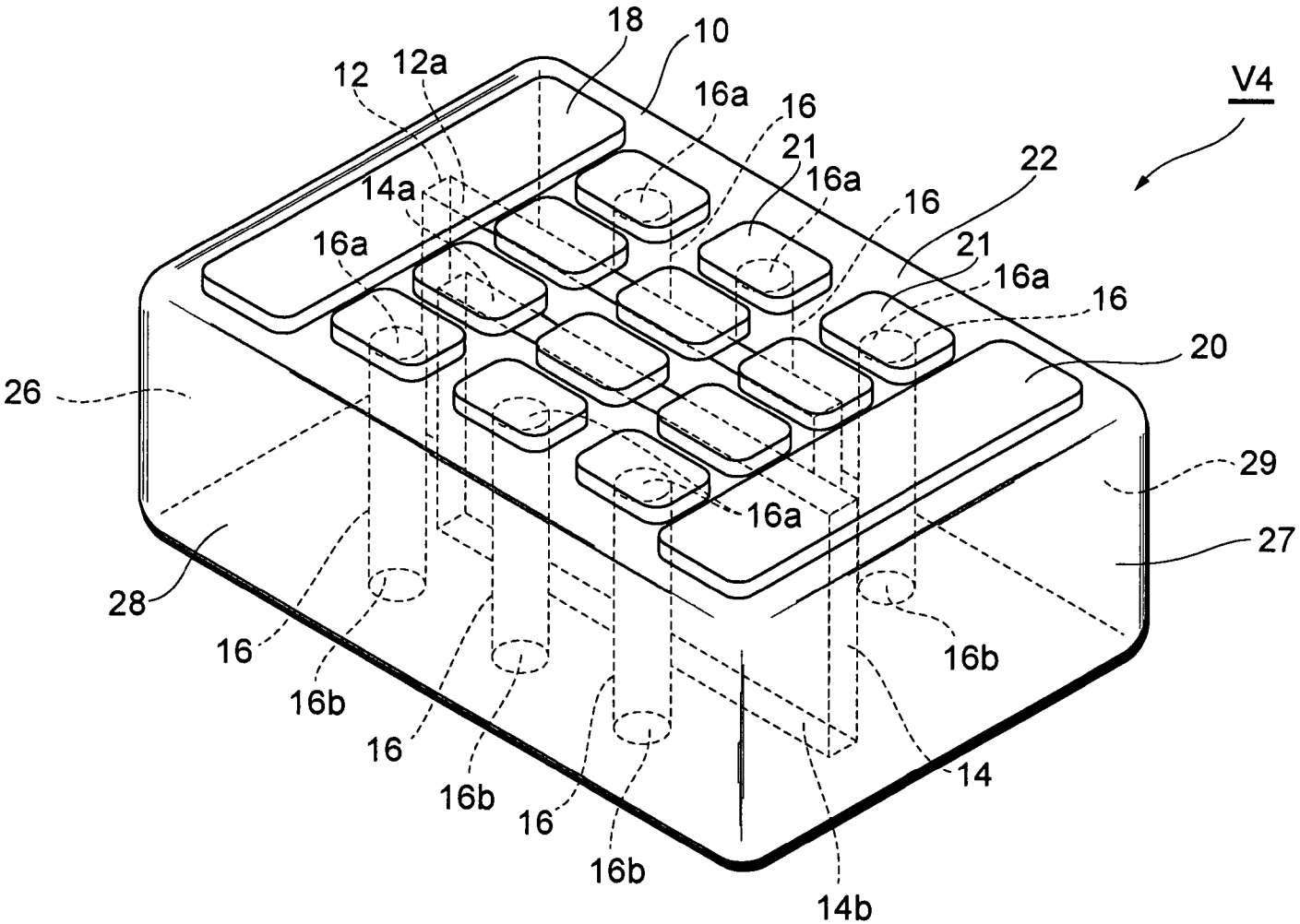
FIG. 10 is a perspective view of a laminated chip varistor pertaining to a fourth embodiment.
Figure 11:
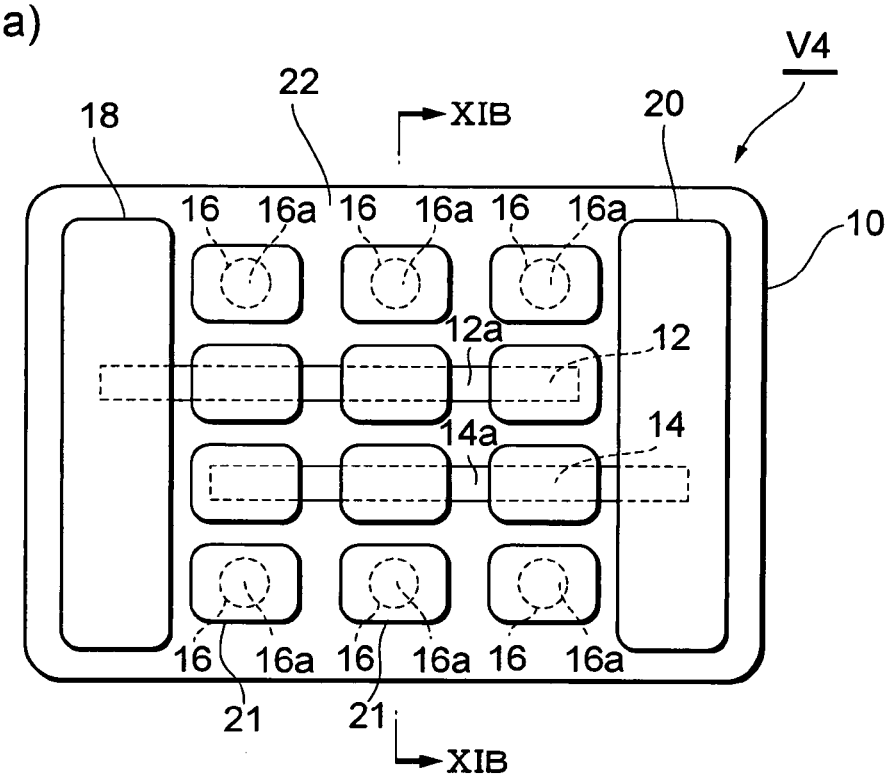
FIG. 11 is (a): a plan view of the laminated chip varistor pertaining to the fourth embodiment and (b): an end view along the line XIB-XIB of (a)
Figure 11:
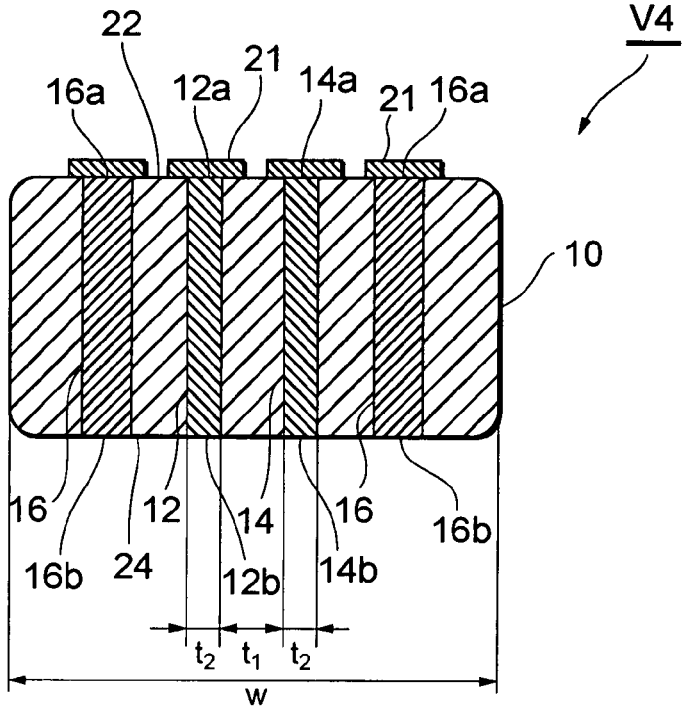

The configuration of a laminated chip varistor V4 pertaining to a fourth embodiment will be hereinafter described with reference to FIG. 10 and FIG. 11. FIG. 10 is a perspective view of a laminated chip varistor pertaining to the fourth embodiment. FIG. 11 is (a): a plan view of the laminated chip varistor pertaining to the fourth embodiment and (b): an end view along the line XIB-XIB of (a). The laminated chip varistor V4 pertaining to the fourth embodiment differs from the laminated chip varistor V1 pertaining to the first embodiment described above in the shape of the first and second inner electrodes 12, 14 and the shape of the heat conductors 16.

A pair of first and second inner electrodes 12, 14 and six heat conductors 16 are provided in the varistor body 10 of the laminated chip varistor V4 pertaining to the fourth embodiment. The first and second inner electrodes 12, 14 are formed into a substantially rectangular-shaped thick plate body. The heat conductors 16 have a substantially cylinder shape extending in the opposing direction of the first outer face 22 and the second outer face 24. Because, for this reason, the cross-sectional area in the direction in which the first and second inner electrodes 12, 14 and the heat conductors 16 extend is larger in the laminated chip varistor V4 pertaining to the fourth embodiment than in the laminated chip varistor V1 pertaining to the first embodiment described above, the heat of the semiconductor light emitting element 30 can be even more efficiently dissipated.

In the laminated chip varistor V4 pertaining to the fourth embodiment it is preferable that a thickness t1 of the varistor layer sandwiched between the first and second inner electrodes 12, 14 as shown in (b) of FIG. 11 be no less than 10 μm. A varistor voltage of the laminated chip varistor V4 of a constant voltage is ensured by adoption of a thickness t1 of no less than 10 μm. In addition, it is preferable that the thickness t41 of the laminated chip varistor V4 pertaining to the fourth embodiment be no greater than 300 μm. While the varistor voltage can be more reliably obtained by adoption of a thickness t1 of no greater than 300 μm, a thickness t1 in excess of 300 μm necessitates an increase in the sintering temperature and manufacturing difficulties.

In addition, taking the sum of a thickness t2 of the first and second inner electrodes 12, 14 as Σt2 and a width of the varistor body 10 as W in the laminated chip varistor V4 pertaining to the fourth embodiment as shown in (b) of FIG. 11, it is preferable that Σt2 satisfy the relationship 10 μm≦Σt2≦W−30 μm. In this arrangement, effective heat dissipating characteristics can be demonstrated by the first and second inner electrodes 12, 14.

Fifth Embodiment

Figure 12:
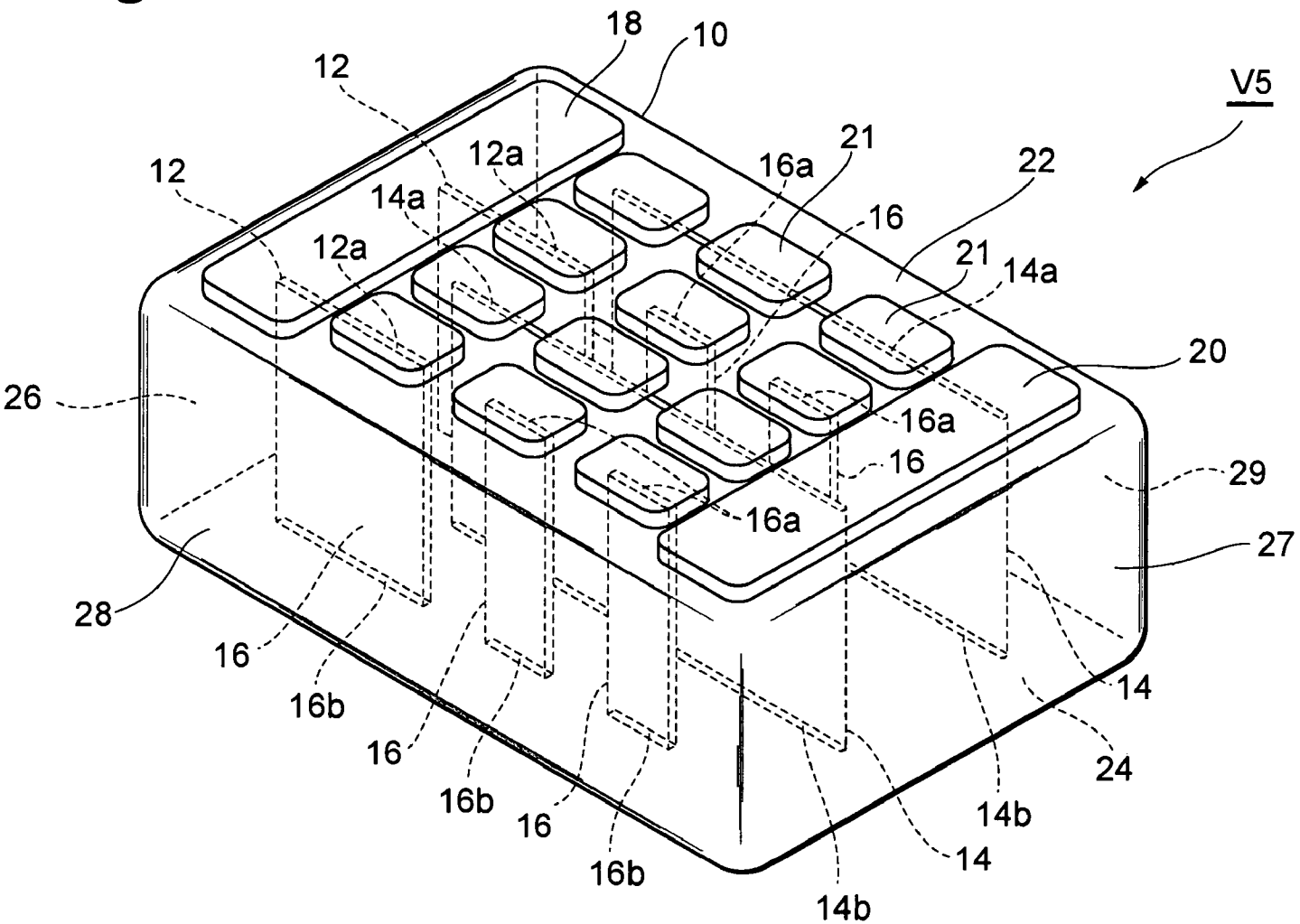
FIG. 12 is a perspective view of a laminated chip varistor pertaining to a fifth embodiment.
Figure 13:
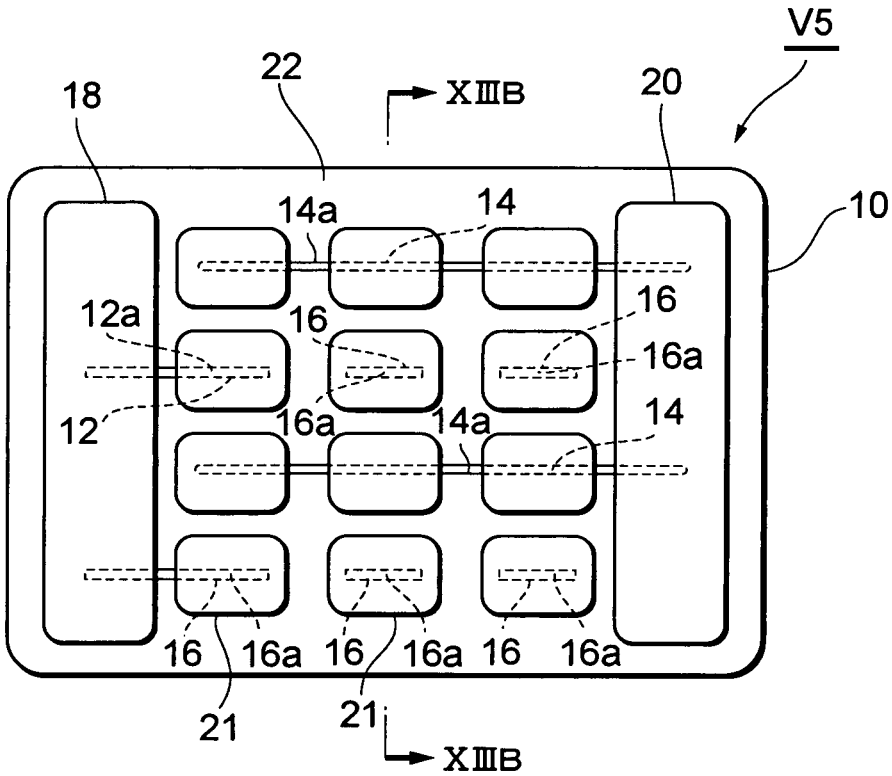
FIG. 13 is (a): a plan view of the laminated chip varistor pertaining to the fifth embodiment and (b): an end view along the line XIIIB-XIIIB of (a)
Figure 13:
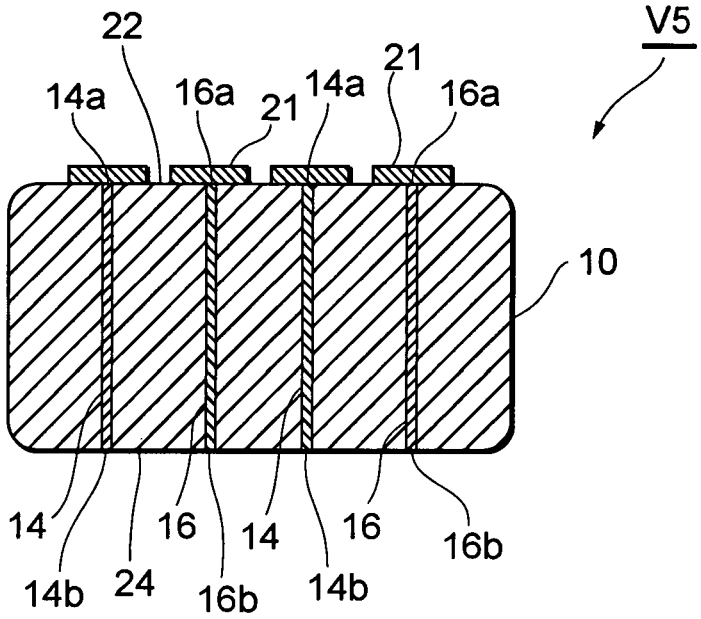

The configuration of a laminated chip varistor V5 pertaining to a fifth embodiment will be hereinafter described with reference to FIG. 12 and FIG. 13. FIG. 12 is a perspective view of a laminated chip varistor pertaining to the fifth embodiment. FIG. 13 is (a): a plan view of the laminated chip varistor pertaining to the fifth embodiment and (b): an end view along the line XIIIB-XIIIB of (a). The laminated chip varistor V5 pertaining to the fifth embodiment differs from the laminated chip varistor V1 pertaining to the first embodiment described above in the arrangement of the first and second inner electrodes 12, 14 and the heat conductors 16 in the varistor body 10.

Two first and second inner electrodes 12, 14 pairs and four heat conductors 16 are provided in the varistor body 10 of the laminated chip varistor V5 pertaining to the fifth embodiment. One inner electrode 12 and two heat conductors 16 are disposed on the same varistor layer with a predetermined interval from the side face parallel with the laminating direction and with a predetermined interval that affords electrical insulation, the first inner electrode 12 thereof being disposed toward the side face 26 of the varistor body 10. The second inner electrode 14 is alternatingly disposed next to the first inner electrode 12 in the laminating direction. The first inner electrode 12 and the second inner electrode 14 form an opposing face in a section toward the side face 26 of the varistor body 10 and, as seen from the laminating direction, a region of the varistor layer in which the first inner electrode 12 and the second inner electrode 14 overlap factions as a region that exhibits varistor characteristics. In the laminated chip varistor V5 pertaining to the fifth embodiment of this configuration, the heat of the semiconductor light emitting element 30 can be more efficiently dissipated.

Sixth Embodiment

Figure 14:
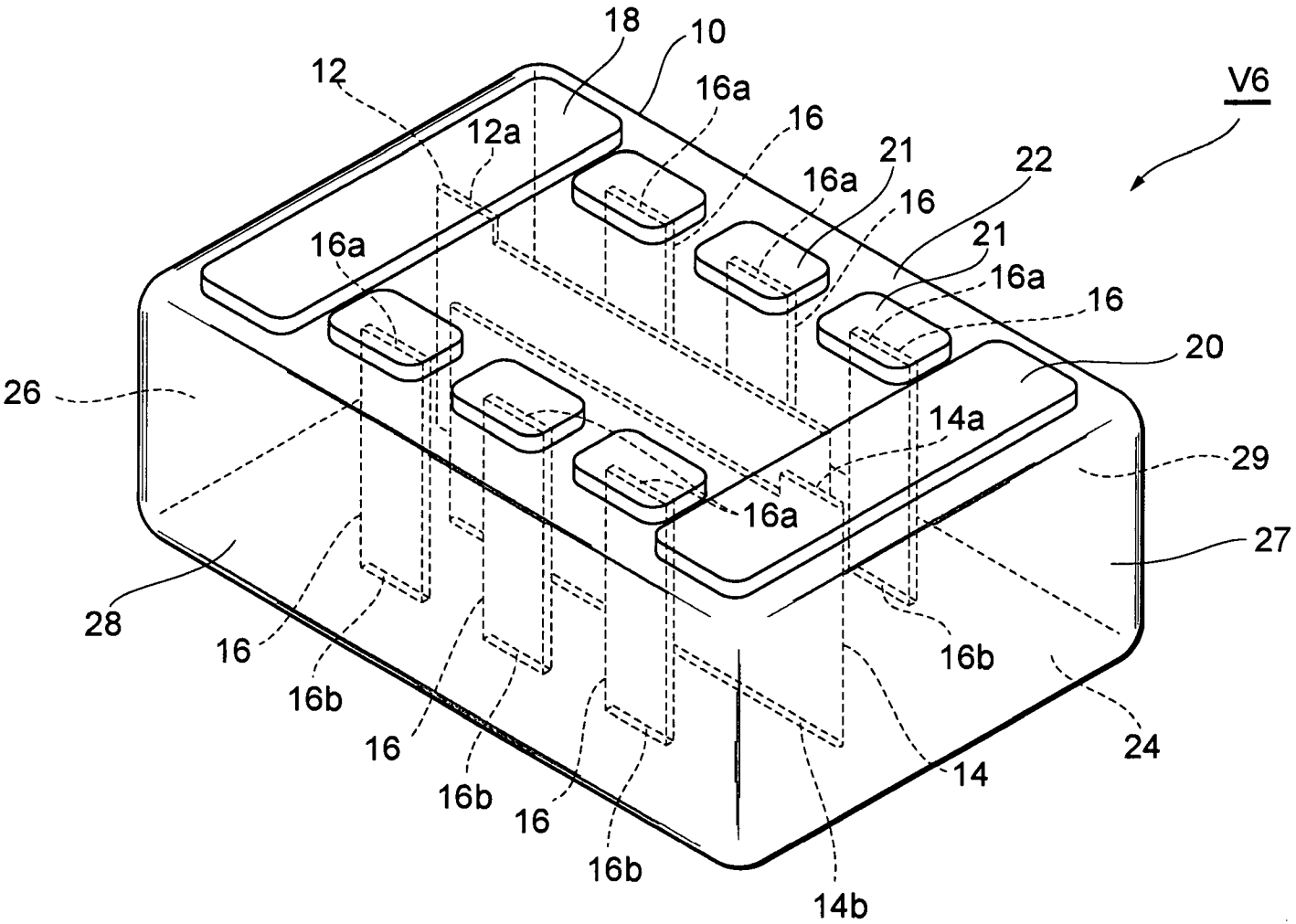
FIG. 14 is a perspective view of a laminated chip varistor pertaining to a sixth embodiment.
Figure 15:
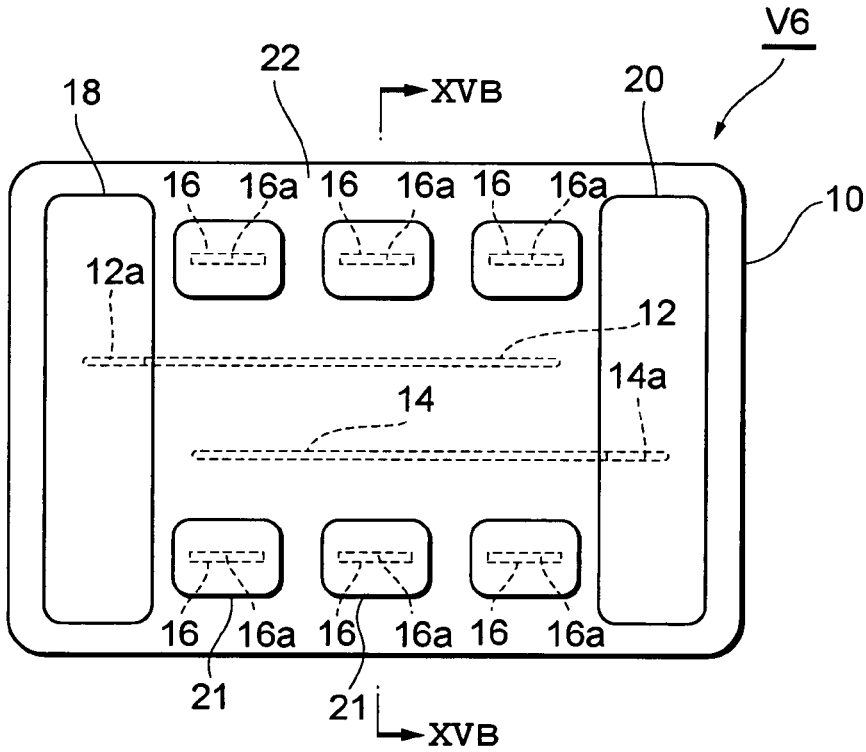
FIG. 15 is (a): a plan view of the laminated chip varistor pertaining to the sixth embodiment and (b): an end view along the line XVB-XVB of (a)
Figure 15:
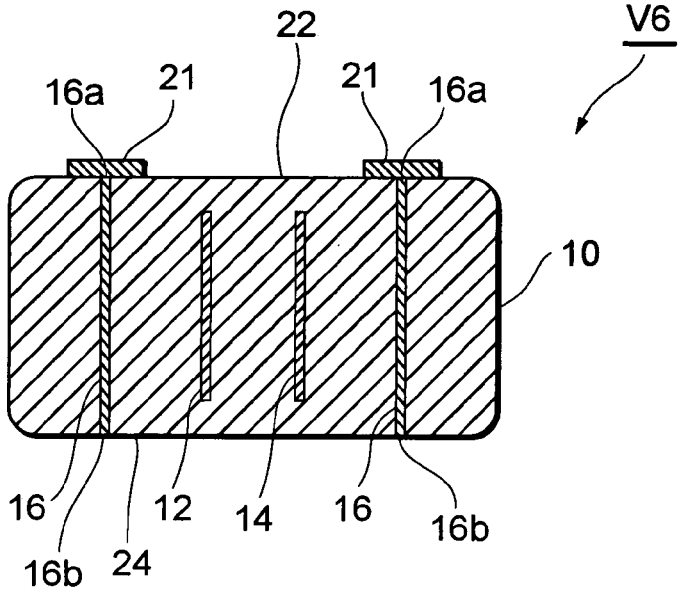

The configuration of a laminated chip varistor V6 pertaining to a sixth embodiment will be hereinafter described with reference to FIG. 14 and FIG. 15. FIG. 14 is a perspective view of a laminated chip varistor pertaining to the sixth embodiment. FIG. 15 is (a): a plan view of the laminated chip varistor pertaining to the sixth embodiment and (b): an end view along the line XVB-XVB of (a). The laminated chip varistor V6 pertaining to the sixth embodiment differs from the laminated chip varistor V1 pertaining to the first embodiment described above in the shape of the first and second inner electrodes 12, 14.

A pair of first and second inner electrodes 12, 14 are provided in the varistor body 10 of the laminated chip varistor V6 pertaining to the sixth embodiment. The first and second inner electrodes 12, 14 are formed into a substantially L-shaped thin plate body (see FIG. 14). End faces 12*a*, 14*a* alone of a tip-end section forming the substantially L-shape of the first and second inner electrodes 12, 14 are drawn to a first outer face 22 to face onto the first outer face 22, and are exposed on the first outer face 22. First and second outer electrodes 18, 20 are formed on the first outer face 22 to be physically and electrically connected with the end faces 12*a*, 14*a* respectively of the first and second inner electrodes 12, 14 exposed on the first outer face 22.

Figure 16:
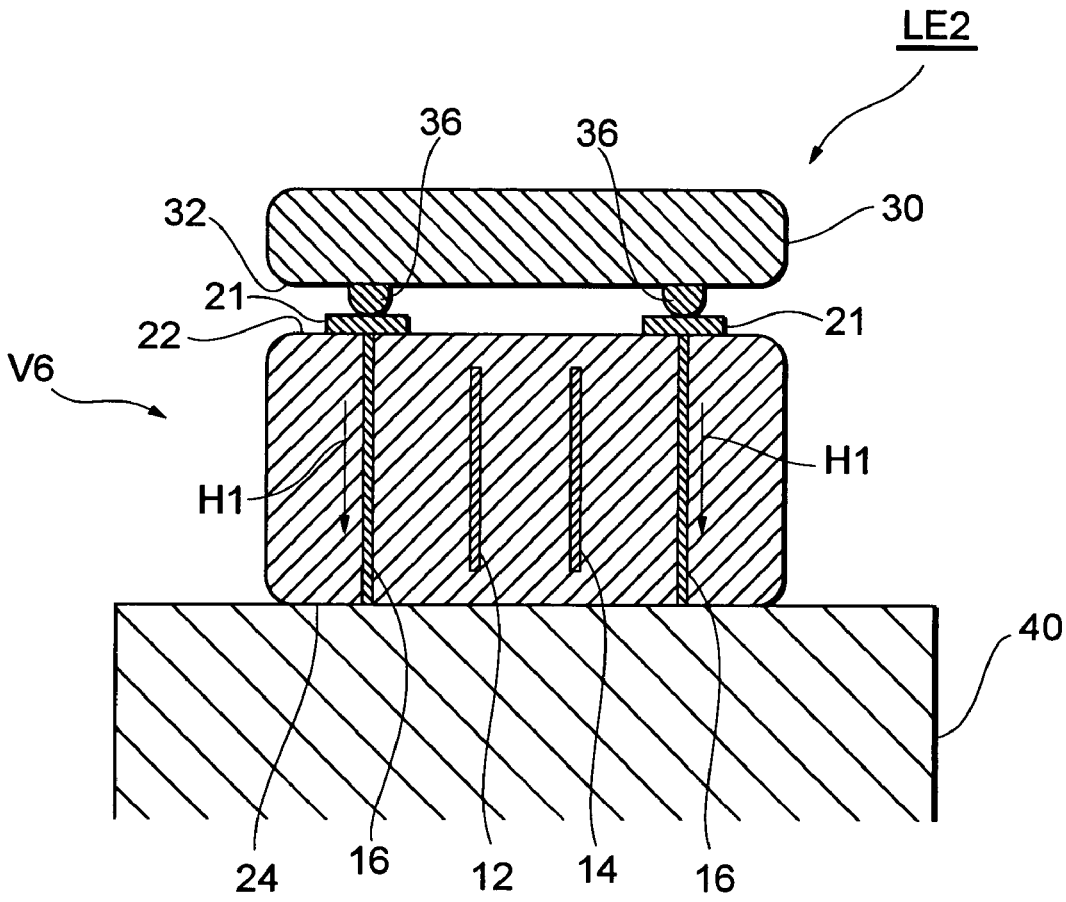
FIG. 16 is a vertical cross-sectional view of a light emitting device employing the laminated chip varistor pertaining to the sixth embodiment.

For this reason, in a light emitting device LE2 in which the laminated chip varistor V6 pertaining to the sixth embodiment has connection with a semiconductor light emitting element 30, the first and second inner electrodes 12, 14 are not physically connected with bump electrodes 34 (see FIG. 16), and the end face 16*a* of the heat conductors 16 and the bump electrodes 34 are physically and electrically connected. Accordingly, in a laminated chip varistor V6 pertaining to a sixth embodiment having this configuration, because the heat of the semiconductor light emitting element 30 is transferred by way of the bump electrodes 34 along the heat conductors 16 from the first outer face 22 toward the second outer face 24 (see arrow H1 of FIG. 16), the heat of the semiconductor light emitting element 30 can be efficiently dissipated.

Seventh Embodiment

Figure 17:
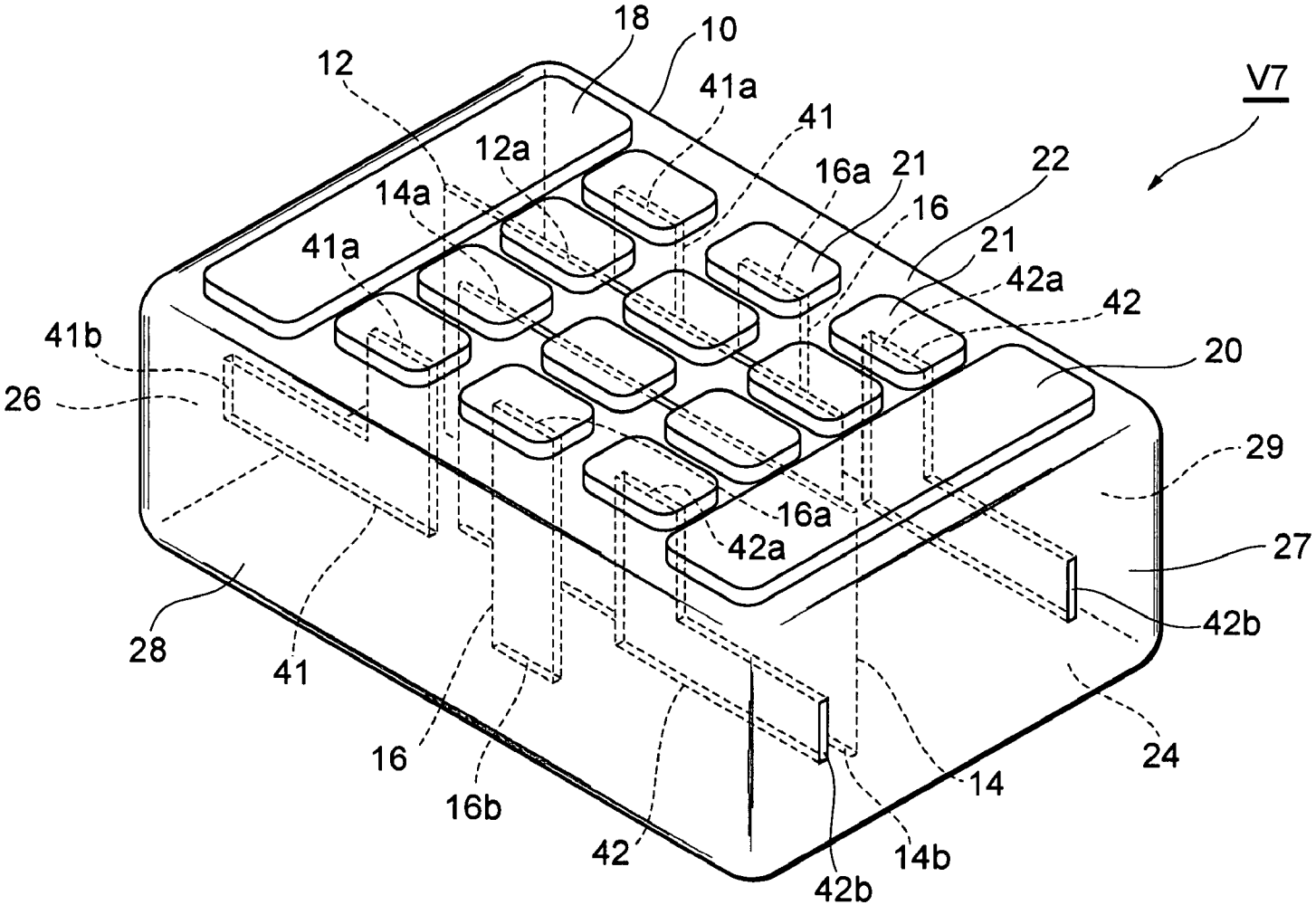
FIG. 17 is a perspective view of a laminated chip varistor pertaining to a seventh embodiment.

The configuration of a laminated chip varistor V7 pertaining to a seventh embodiment will be hereinafter described with reference to FIG. 17. FIG. 17 is a perspective view of the laminated chip varistor pertaining to the seventh embodiment. The laminated chip varistor V7 pertaining to the seventh embodiment differs from the laminated chip varistor V1 pertaining to the first embodiment described above in the provision in the varistor body 10 of two each of heat conductors 41, 42.

The heat conductors 41 are formed into a thin plate body bent in a substantially L-shape, one end face 41*a* thereof being drawn to the first outer face 22 to face onto the first outer face 22, and the other end face 41*b* thereof being drawn to the first side face 26 to face onto the first side face 26. That is to say, the heat conductors 41 are formed in the varistor body 10 to extend in a direction from the first outer face 22 to the first side face 26, the end face 41*a* of the heat conductors 41 being exposed on the first outer face 22, and the end face 41*b* of the heat conductors 41 being exposed on the first side face 26.

The heat conductors 42 are formed into a thin plate body bent in a substantially L-shape, one end face 42*a* thereof being drawn to the first outer face 22 to face onto the first outer face 22, and the other end face 42*b* thereof being drawn to a second side face 27 to face onto the second side face 27. That is to say, the heat conductors 42 are formed in the varistor body 10 to extend in a direction from the first outer face 22 to the second side face 27, the end face 42*a* of the heat conductors 42 being exposed on the first outer face 22, and the end face 42*b* of the heat conductor 42 being exposed on the second side face 27.

For this reason, in the laminated chip varistor V7 pertaining to the seventh embodiment, the heat of the semiconductor light emitting element 30 is transferred not only along the heat conductors 16 from the first outer face 22 toward the second outer face 24 but also along the heat conductors 41, 42 to the first and second side faces 26, 27. As a result, by arrangement in a heat sink or the like of the laminated chip varistor V7 so that the second outer face 24 and the first to fourth sides faces 26 to 29 of the laminated chip varistor V7 pertaining to the seventh embodiment are covered, the heat from the semiconductor light emitting element 30 can be efficiently dissipated. Heat conductors extending in the direction from the first outer face 22 to the third side face 28 or the fourth side face 29 are additionally provided in the varistor body 10.

Eighth Embodiment

Figure 18:
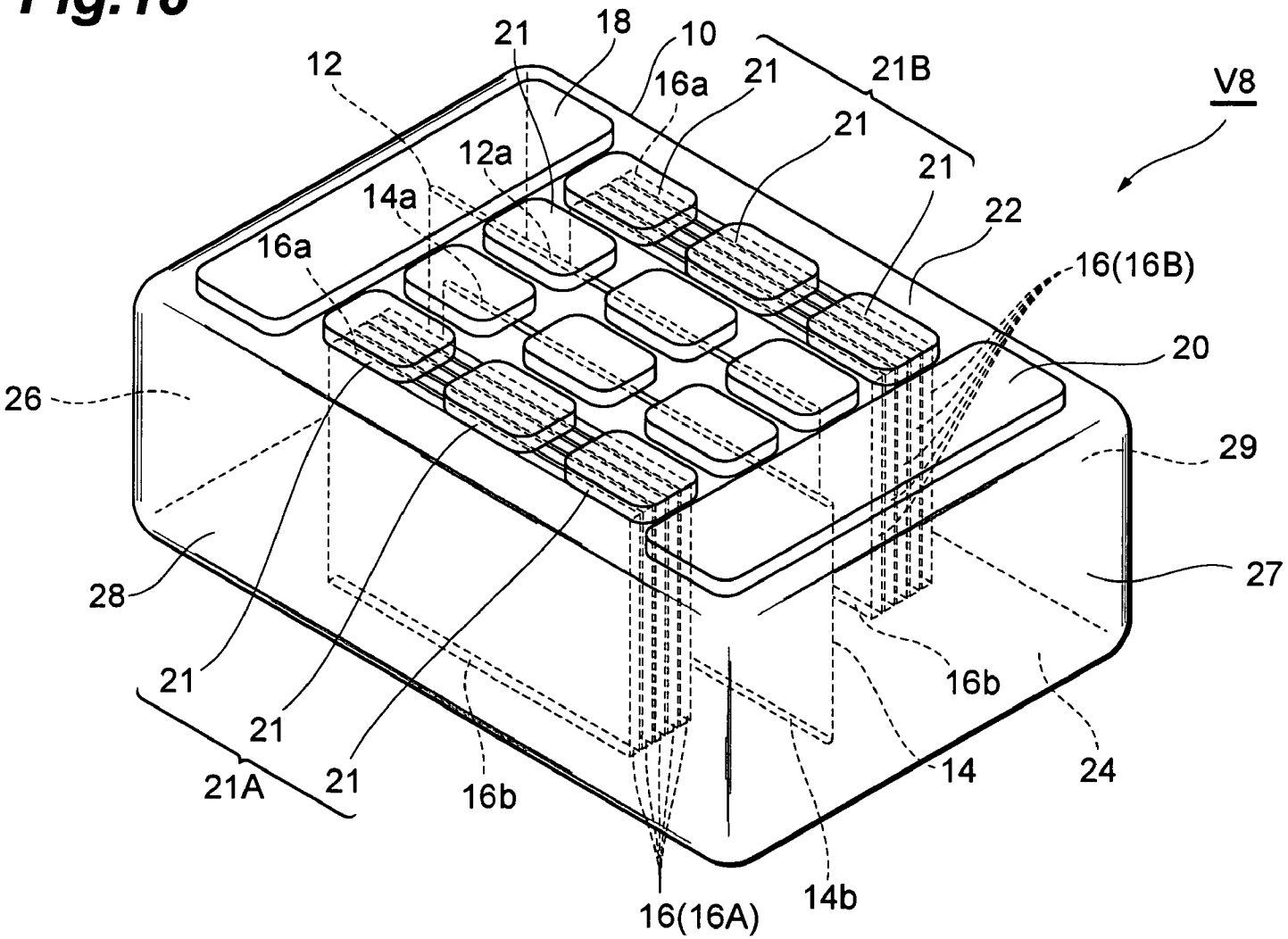
FIG. 18 is a perspective view of a laminated chip varistor pertaining to an eighth embodiment.
Figure 19:
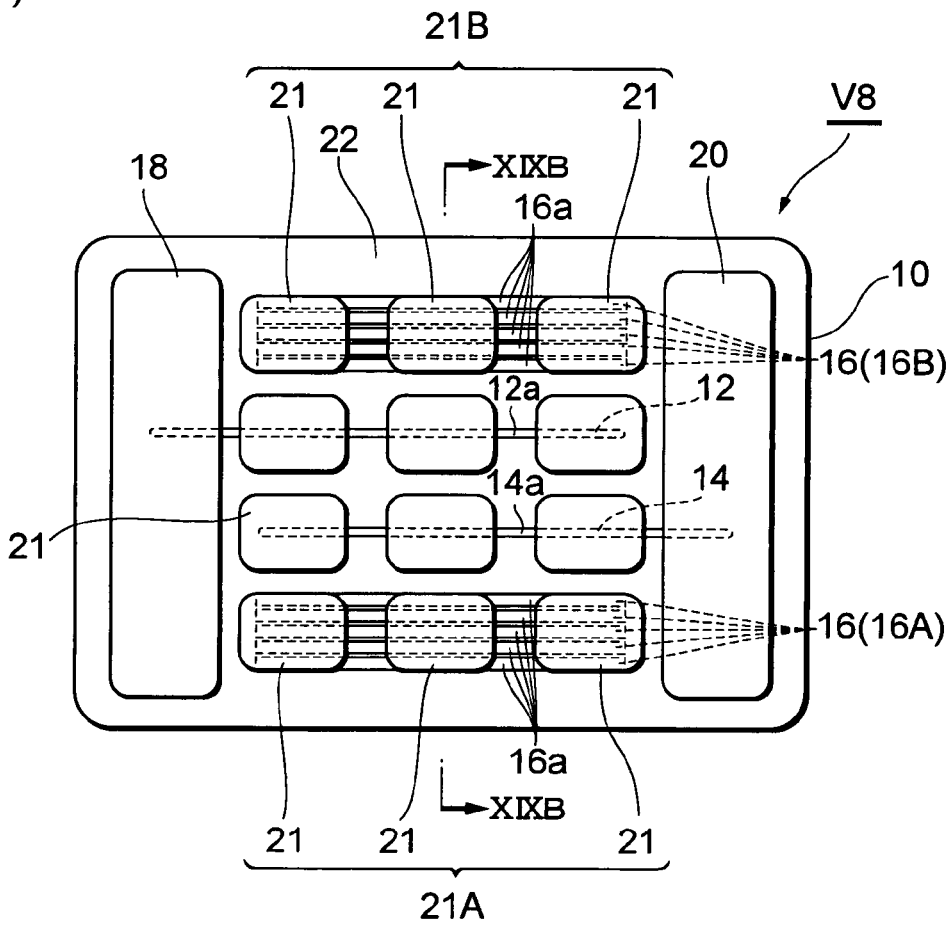
FIG. 19 is (a): a plan view of the laminated chip varistor pertaining to the eighth embodiment and (b): an end view along the line XIXB-XIXB of (a)
Figure 19:
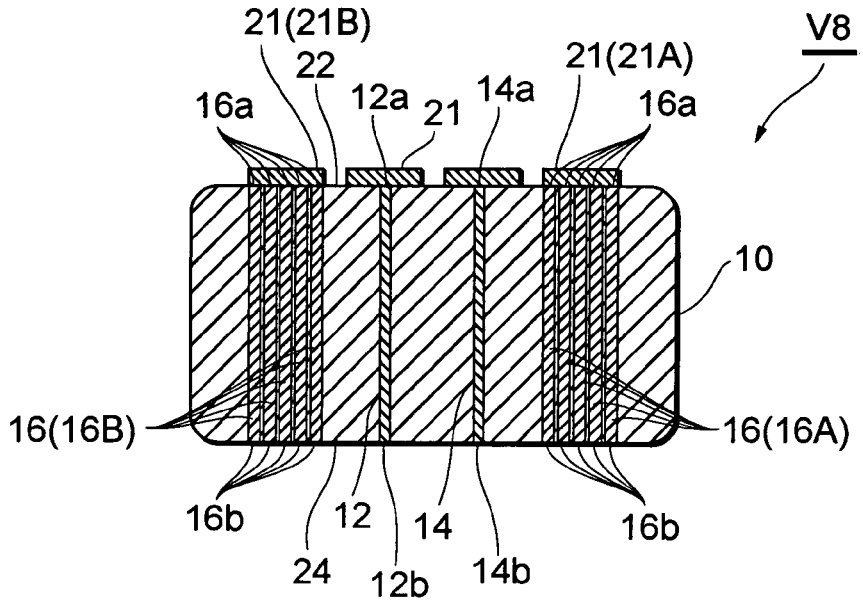

The configuration of a laminated chip varistor V8 pertaining to an eighth embodiment will be hereinafter described with reference to FIG. 18 and FIG. 19. FIG. 18 is a perspective view of a laminated chip varistor pertaining to the eighth embodiment. FIG. 19 is (a): a plan view of the laminated chip varistor pertaining to the eighth embodiment and (b): an end view along the line XIXB-XIXB of (a). The laminated chip varistor V8 pertaining to the eighth embodiment differs from the laminated chip varistor V1 pertaining to the first embodiment described above in the shape of the heat conductors 16.

Two groups (heat conductor groups 16A, 16B) of a plurality (five in the eighth embodiment) of heat conductors 16 are provided in the varistor body 10 of the laminated chip varistor V8 pertaining to the eighth embodiment. The heat conductor group 16A is disposed nearer the third side face 28 of the varistor body 10. The heat conductor group 16B is disposed nearer the fourth side face 29 of the varistor body 10.

The heat conductors 16 are formed into a substantially rectangular-shaped thin plate body. The width of the heat conductors 16 in the opposing direction of the first and second side faces 26, 27 is set to a magnitude shorter than the straight-line distance between the first and second outer electrodes 18, 20 to prevent electrical connection with the first and second outer electrodes 18, 20. It is preferable that the thickness of the heat conductors 16 be set larger than the thickness of the inner electrodes 12, 14.

One end face 16*a* of the heat conductors 16 is drawn to the first outer face 22 to face onto the first outer face 22, and the other end face 16*b* is drawn to the second outer face 24 to face onto the second outer face 24. For this reason, three connecting terminals 21 (connecting terminal group 21A) disposed nearer the third side face 28 along the opposing direction of the first and second side faces 26, 27 are physically and thermally connected with one end face 16*a* of the heat conductors 16 from which the heat conductor group 16A is configured to cover predetermined regions thereof. Three connecting terminals 21 (connecting terminal group 21B) disposed nearer the fourth side face 29 along the opposing direction of the first and second side faces 26, 27 are physically and thermally connected with the end face 16*a* of the heat conductors 16 from which the heat conductor group 16B is configured to cover predetermined regions thereof.

In the laminated chip varistor V8 pertaining to the eighth embodiment described above, because each of the heat conductor groups 16A, 16B are configured from a plurality of heat conductors 16, the cross-sectional area in the direction in which the heat conductors 16 extend (opposing direction of the first and second outer faces 22, 24) is larger than in the laminated chip varistor V1 pertaining to the first embodiment. For this reason, the heat of the semiconductor light emitting element 30 can be more efficiently dissipated.

Ninth Embodiment

Figure 20:
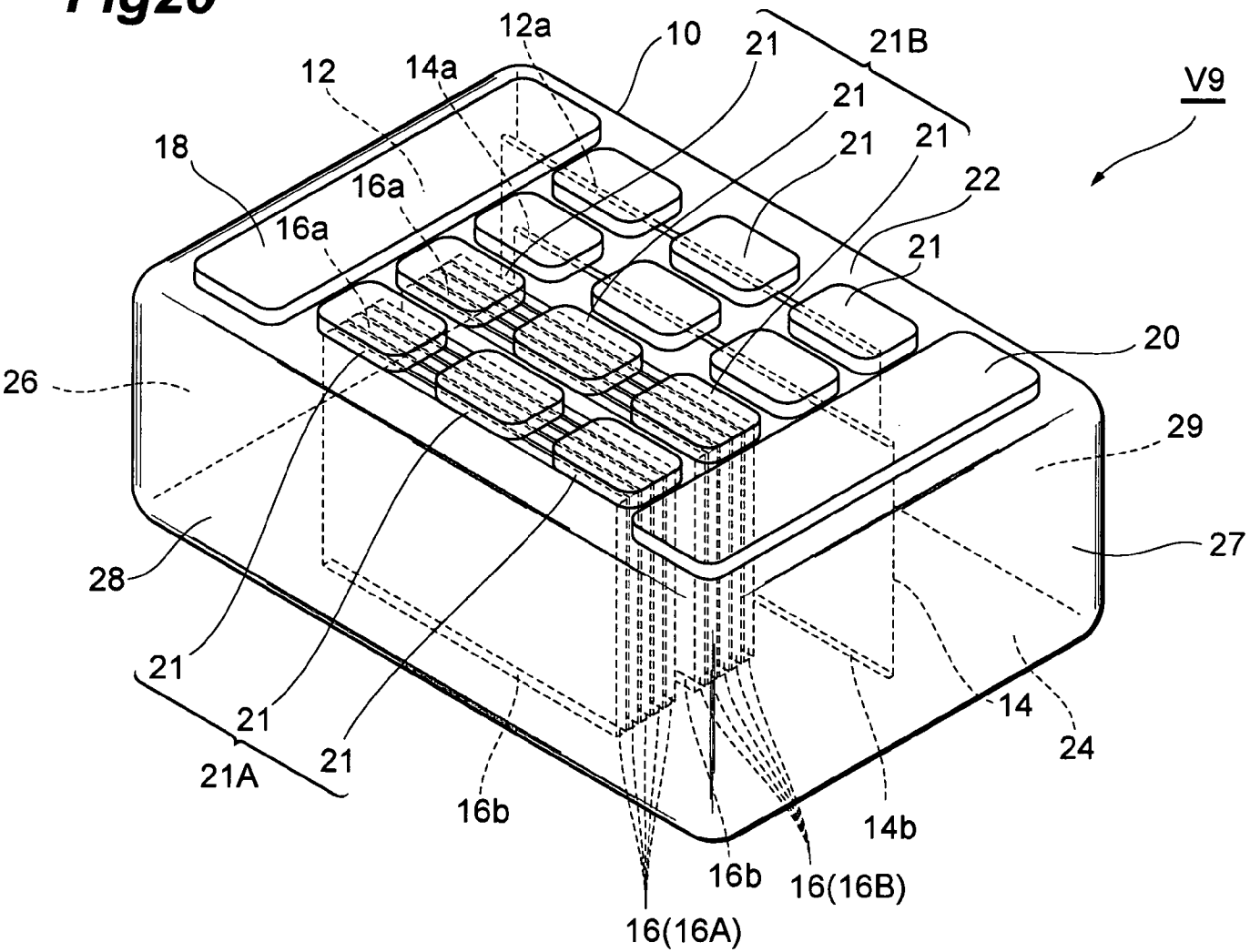
FIG. 20 is a perspective view of a laminated chip varistor pertaining to a ninth embodiment.
Figure 21:
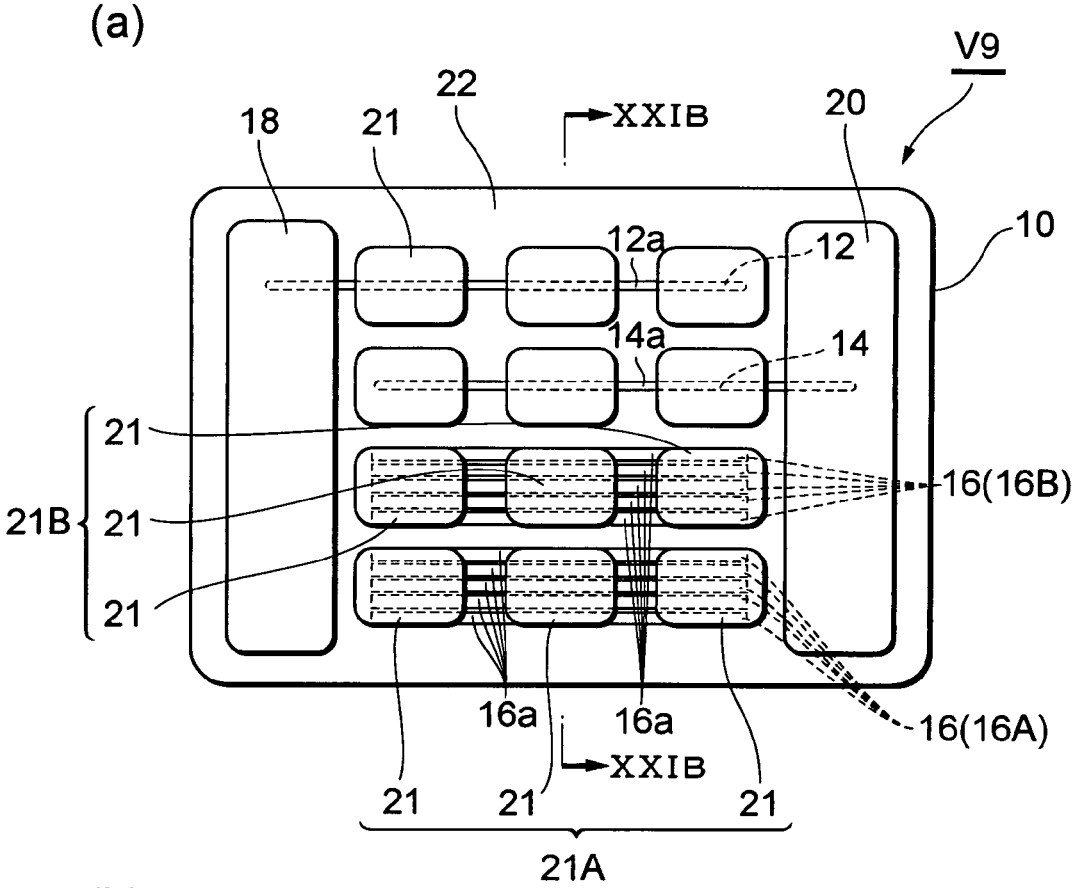
FIG. 21 is (a): a plan view of the laminated chip varistor pertaining to the ninth embodiment and (b): an end view along the line XXIB-XXIB of (a)
Figure 21:
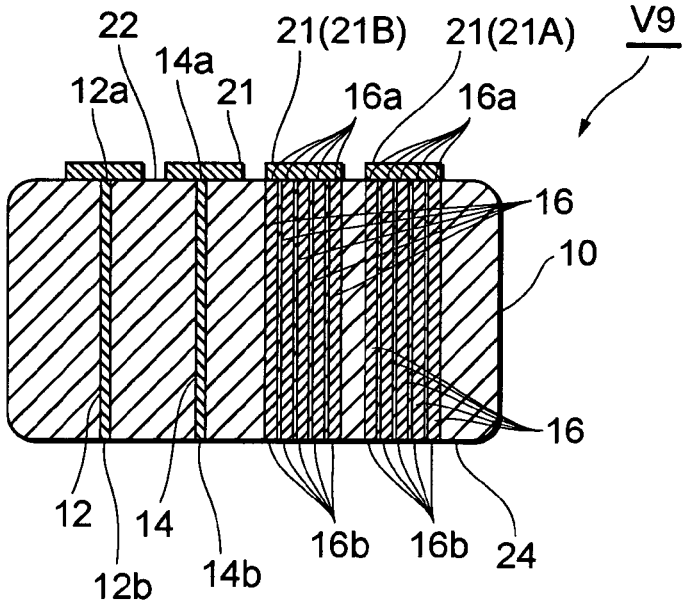

The configuration of a laminated chip varistor V9 pertaining to a ninth embodiment will be hereinafter described with reference to FIG. 20 and FIG. 21. FIG. 20 is a perspective view of a laminated chip varistor pertaining to the ninth embodiment. FIG. 21 is (a): a plan view of the laminated chip varistor pertaining to the ninth embodiment and (b): an end view along the line XXIB-XXIB of (a). The laminated chip varistor V9 pertaining to the ninth embodiment differs from the laminated chip varistor V1 pertaining to the first embodiment described above in the arrangement of the first and second inner electrodes 12, 14, the arrangement of the heat conductors 16, and the shape of the heat conductors 16.

First and second inner electrodes 12, 14 and two groups (heat conductor groups 16A, 16B) of five heat conductors 16 are provided in the varistor body 10 of the laminated chip varistor V9 pertaining to the ninth embodiment. The first and second inner electrodes 12, 14 are disposed nearer the fourth side face 29 of the varistor body 10, the first inner electrode 12 being disposed on the outer side from the second inner electrode 14. The heat conductor groups 16A, 16B are disposed nearer the third side face 28 of the varistor body 10, the heat conductor group 16A being disposed on the outer side from the heat conductor group 16B.

The heat conductors 16 are formed into a substantially rectangular-shaped thin plate body. The width of the heat conductors 16 in the opposing direction of the first and second side faces 26, 27 is set to a magnitude that is shorter than the straight-line distance between the first and second outer electrodes 18, 20 to prevent electrical connection with the first and second outer electrodes 18, 20. It is preferable that the thickness of the heat conductors 16 be set larger than the thickness of the first and second inner electrodes 12, 14.

One end face 16*a* of the heat conductors 16 is drawn to the first outer face 22 to face onto the first outer face 22, and the other end face 16*b* is drawn onto the second outer face 24 to face onto the second outer face 24. For this reason, three connecting terminals 21 (connecting terminal group 21A) disposed nearest to the third side face 28 along the opposing direction of the first and second side faces 26, 27 are physically and thermally connected with one end face 16*a* of the heat conductors 16 from which the heat conductor group 16A is configured to cover predetermined regions thereof. Three connecting terminals 21 (connecting terminal group 21B) disposed nearer the third side face 28 and nearer the fourth side face 29 than the connecting terminal groups 21A along the opposing direction of the first and second side faces 26, 27 are physically and thermally connected with one end face 16*a* of the heat conductors 16 from which the heat conductor group 16B is configured to cover predetermined regions thereof.

Because the heat conductor groups 16A, 16B of the laminated chip varistor V9 pertaining to the ninth embodiment described above are configured from a plurality of heat conductors 16, the cross-sectional area in the direction in which the heat conductors 16 extend (opposing direction of the first and second outer faces 22, 24) is larger than the laminated chip varistor V1 pertaining to the first embodiment described above. For this reason, the heat of the semiconductor light emitting element 30 can be more efficiently dissipated.

Tenth Embodiment

Figure 22:
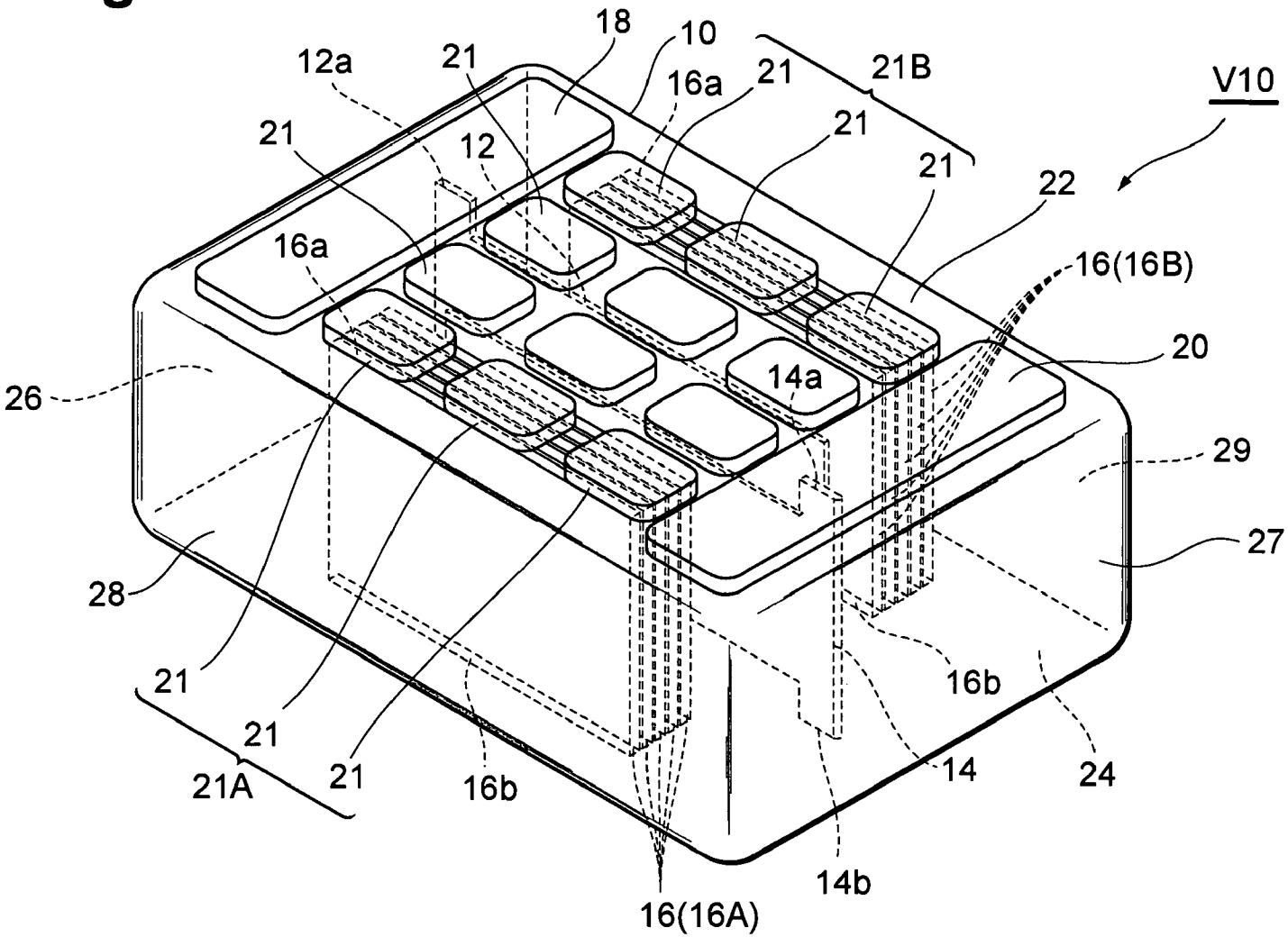
FIG. 22 is a perspective view of a laminated chip varistor pertaining to a tenth embodiment.
Figure 23:
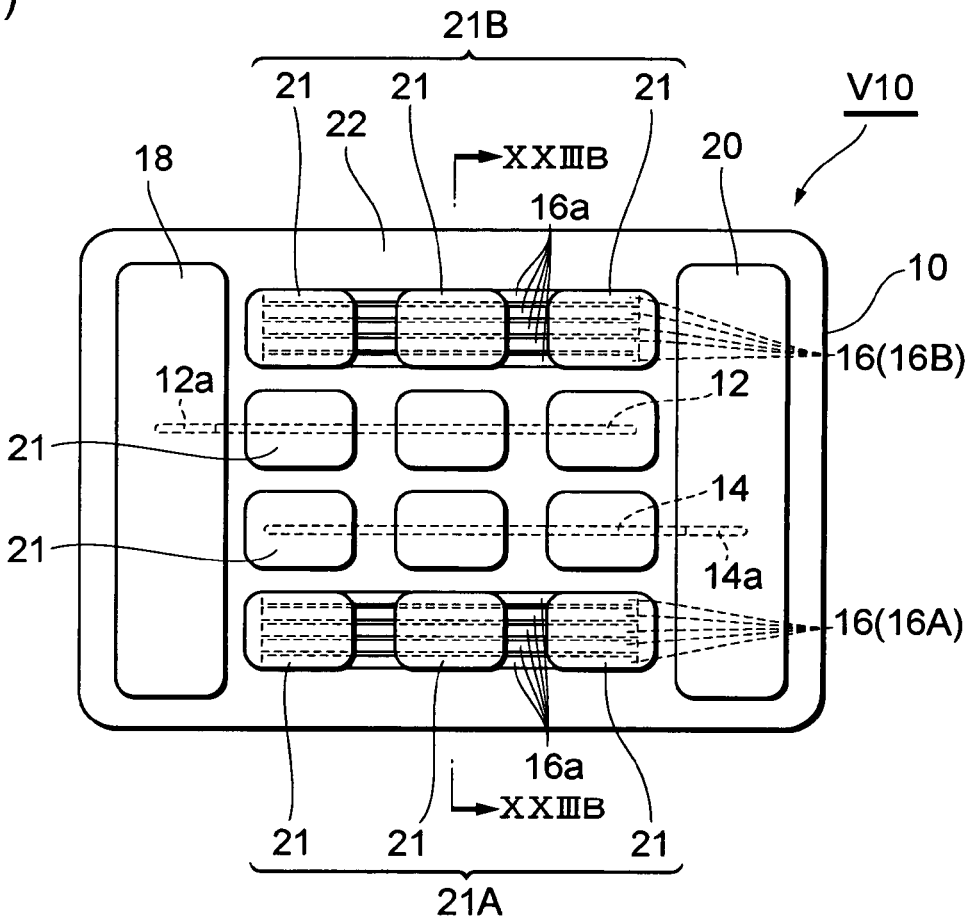
FIG. 23 is (a): a plan view of the laminated chip varistor pertaining to the tenth embodiment and (b): an end view along the line XXIIIB-XIIIB of (a)
Figure 23:
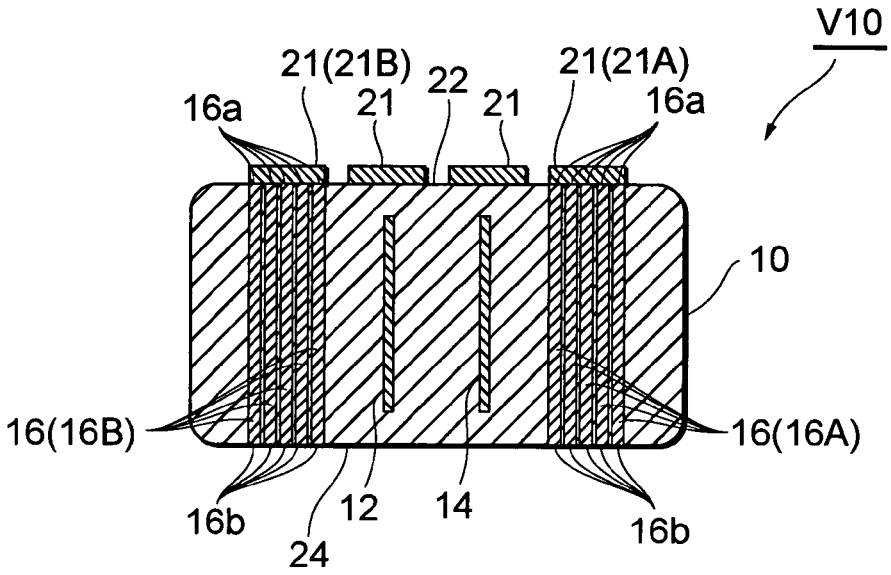

The configuration of a laminated chip varistor V10 pertaining to a tenth embodiment will be hereinafter described with reference to FIG. 22 and FIG. 23. FIG. 22 is a perspective view of a laminated chip varistor pertaining to the tenth embodiment. FIG. 23 is (a): a plan view of the laminated chip varistor pertaining to the tenth embodiment and (b): an end view along the line XXIIIB-XXIIIB of (a). The laminated chip varistor V10 pertaining to the tenth embodiment differs from the laminated chip varistor V1 pertaining to the first embodiment described above in the shape of the first and second inner electrodes 12, 14 and the shape of the heat conductors 16.

First and second inner electrodes 12, 14 and two groups of five heat conductors 16 (heat conductor groups 16A, 16B) are provided in the varistor body 10 of the laminated chip varistor V10 pertaining to the tenth embodiment. The first and second inner electrodes 12, 14 are formed into a substantially T-shaped thin plate body (see FIG. 22). End faces 12*a*, 14*a* of one tip-end section forming a substantially T-shape of the first and second inner electrodes 12, 14 are drawn to the first outer face 22 facing the first outer face 22 and are exposed on the first outer face 22, and other end faces 12*b*, 14*b* of the other tip-end section forming a substantially T-shape are drawn to the second outer face 24 to face onto the second outer face 24 and are exposed on the second outer face 24. First and second outer electrodes 18, 20 are formed on the first outer face 22 so as to have physical and electrical connection with the end faces 12*a*, 14*a* of the first and second inner electrodes 12, 14 exposed on the first outer face 22.

The heat conductor group 16A is disposed nearer the third side face 28 of the varistor body 10. The heat conductor group 16B is disposed nearer the fourth side face 29 of the varistor body 10.

The heat conductors 16 have a substantially rectangular parallele-piped shape. The thickness of the heat conductors 16 in the opposing direction of the first and second side faces 26, 27 is set to a magnitude shorter than the straight-line distance between the first and second outer electrodes 18, 20 to prevent electrical connection with the first and second outer electrodes 18, 20. It is preferable that the thickness of the heat conductors 16 be set larger than the thickness of the first and second inner electrodes 12, 14.

One end face 16*a* of the heat conductors 16 are drawn to the first outer face 22 to face onto the first outer face 22, and the other end face 16*b* is drawn to the second outer face 24 to face onto the second outer face 24. For this reason, the three connecting terminals 21 (connecting terminal group 21A) disposed nearer the third side face 28 along the opposing direction of the first and second side faces 26, 27 are physically and thermally connected with the one end face 16*a* of the heat conductors 16 from which the heat conductor group 16A is configured to cover predetermined regions thereof. The three connecting terminals 21 (connecting terminal group 21B) disposed nearer the fourth side face 29 along the opposing direction of the first and second side faces 26, 27 are physically and thermally connected with the one end face 16*a* of the heat conductors 16 from which the heat conductor group 16B is configured to cover predetermined regions thereof.

Because the heat conductor groups 16A, 16B of the laminated chip varistor V10 pertaining to the tenth embodiment are configured from a plurality of heat conductors 16 as described above, the cross-sectional area in the direction in which the heat conductors 16 extend (opposing direction of the first and second outer faces 22, 24) is larger than the laminated chip varistor V1 pertaining to the first embodiment described above. For this reason, the heat of the semiconductor light emitting element 30 can be more efficiently dissipated.

Eleventh Embodiment

Figure 24:
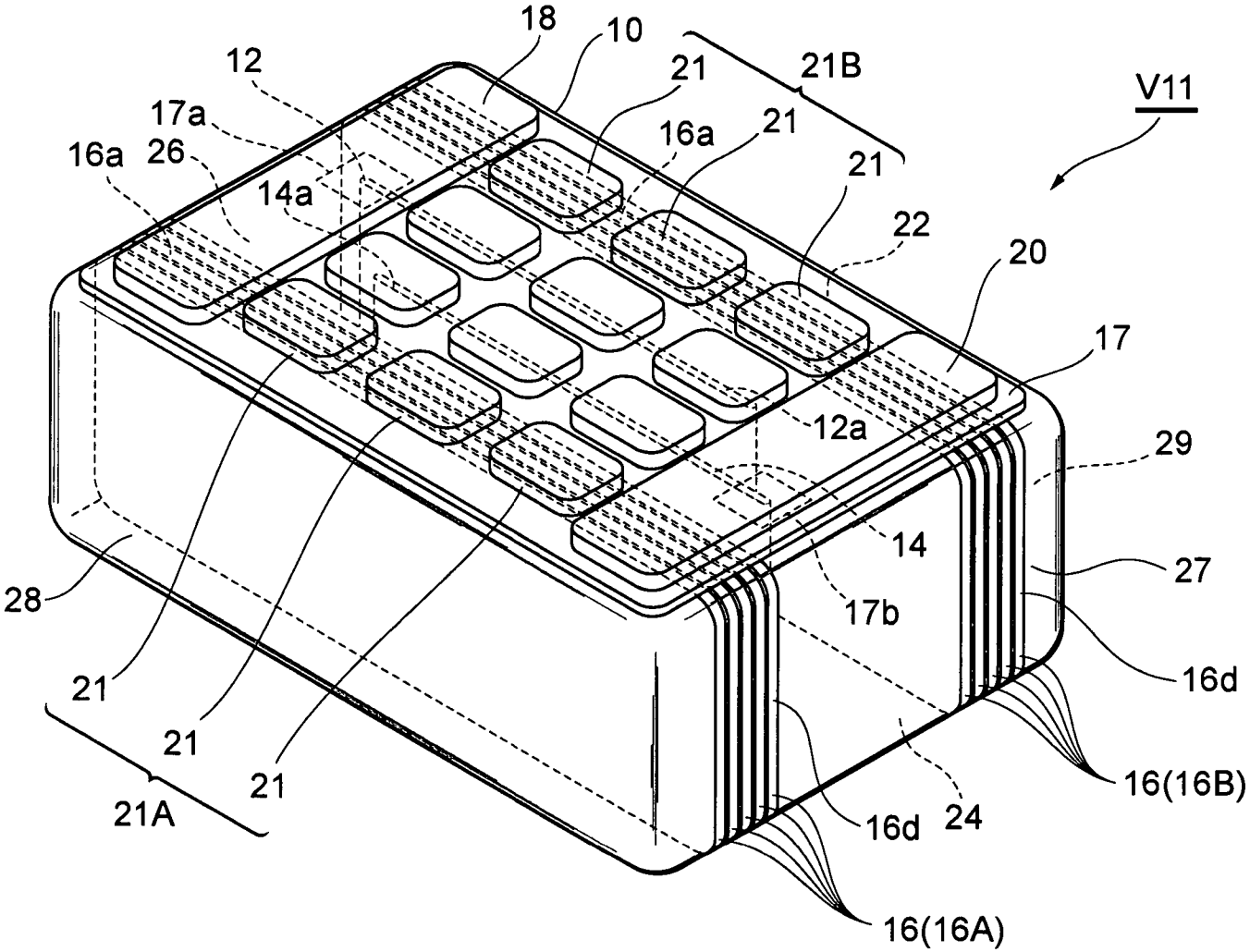
FIG. 24 is a perspective view of a laminated chip varistor pertaining to an eleventh embodiment.
Figure 25:
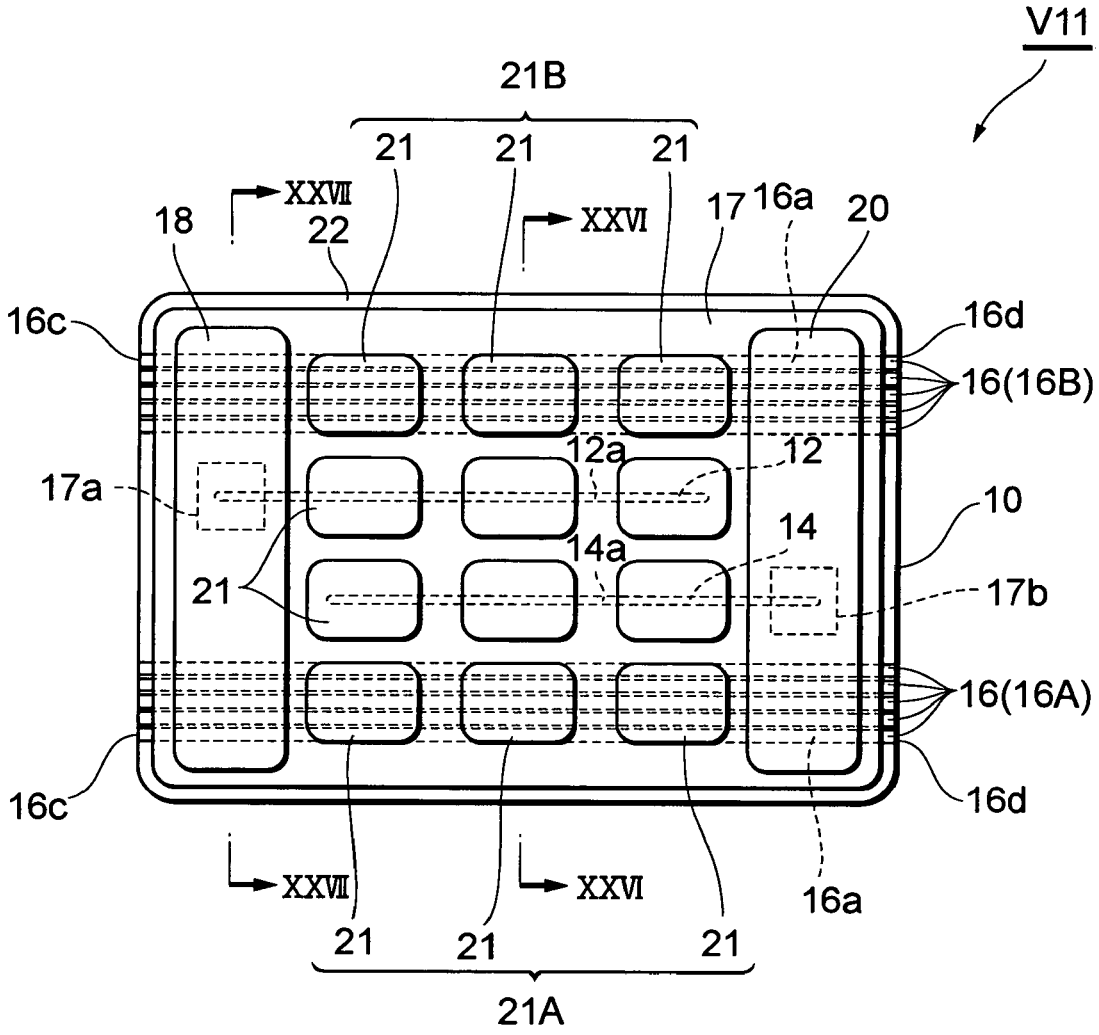
FIG. 25 is a plan view of the laminated chip varistor pertaining to the eleventh embodiment.
Figure 26:
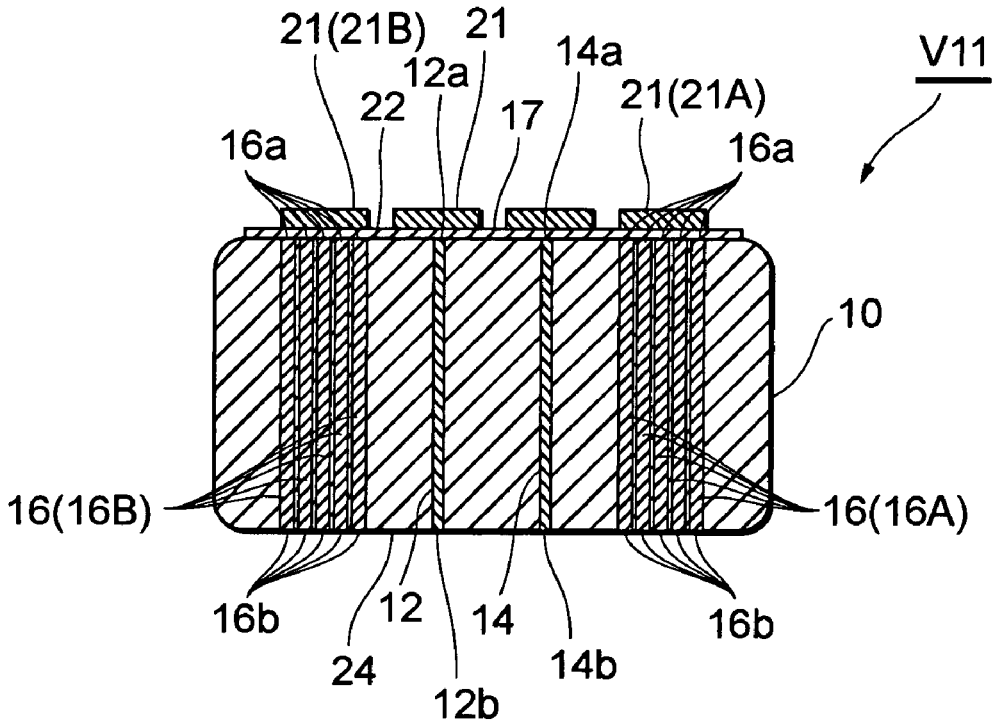
FIG. 26 is an end view along the line XXVI-XXVI of FIG. 25.
Figure 27:
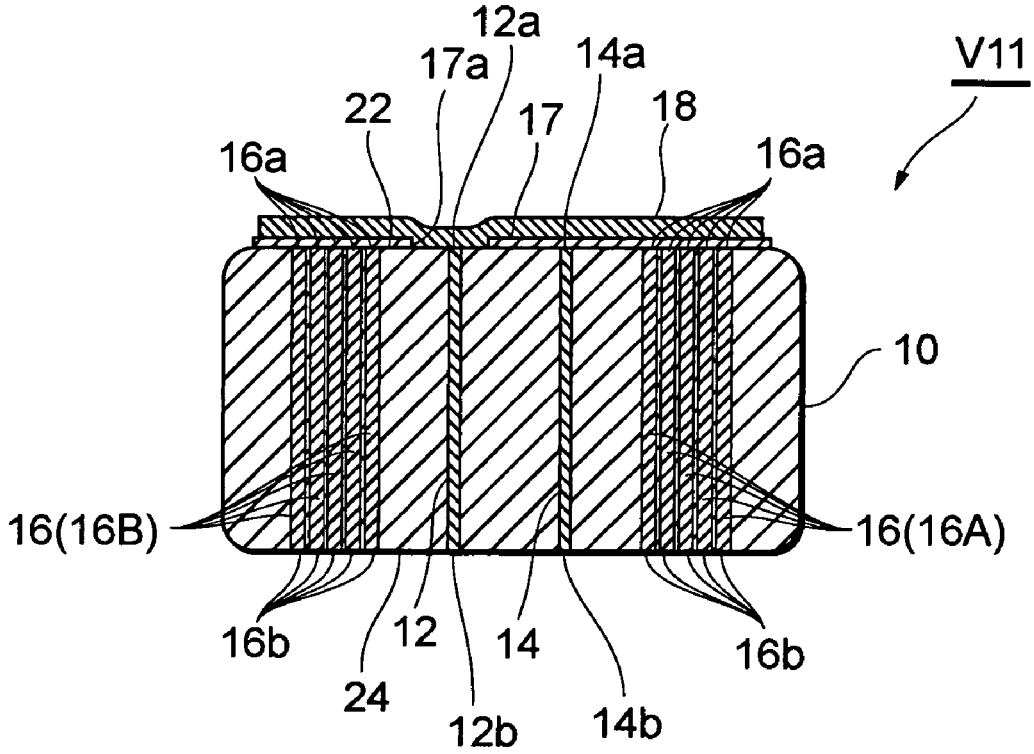
FIG. 27 is an end view along the line XXVII-XXVII of FIG. 25.
Figure 28:
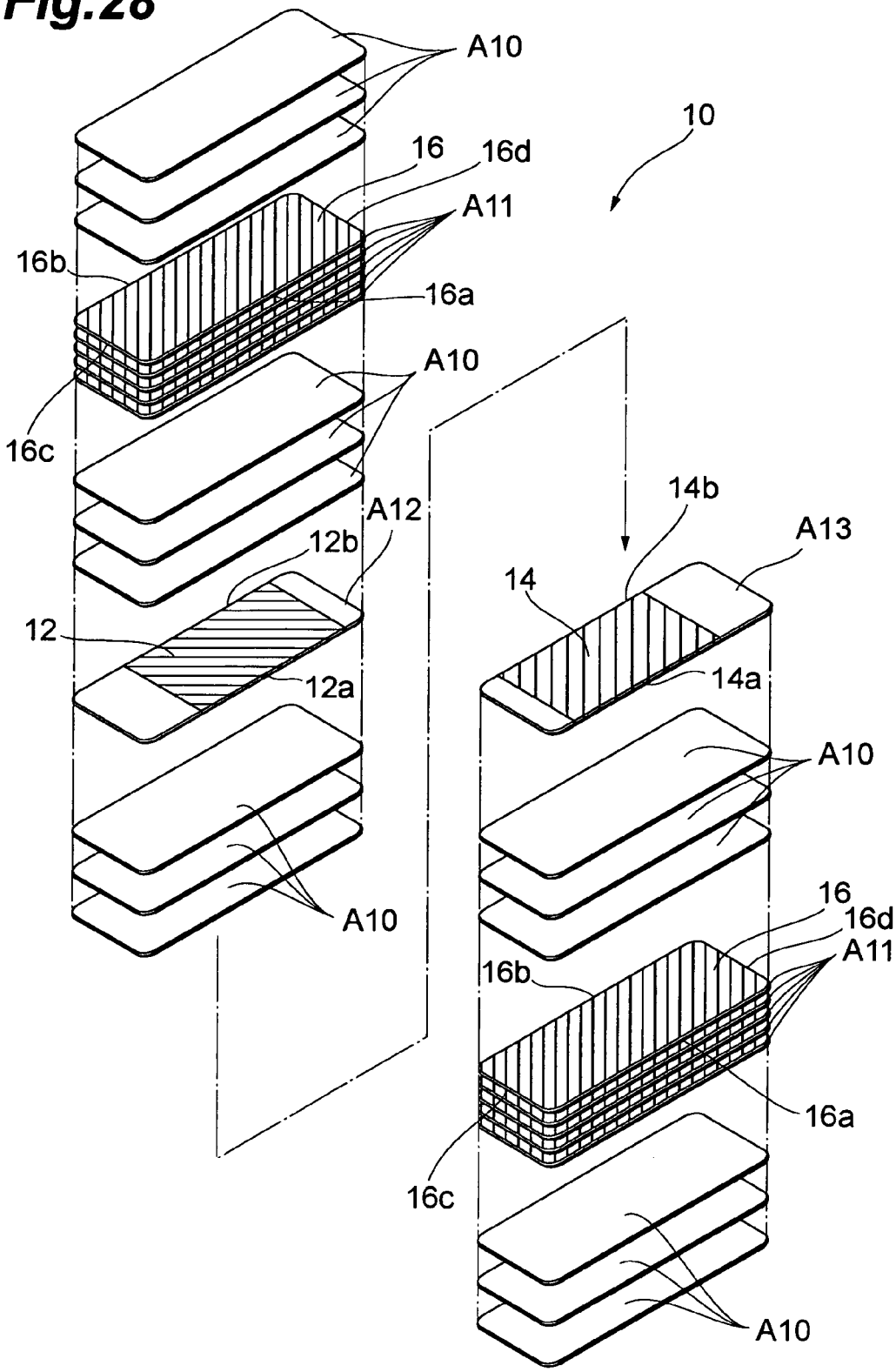
FIG. 28 is an exploded perspective view of a varistor body from which the laminated chip varistor pertaining to the eleventh embodiment is configured.
Figure 29:
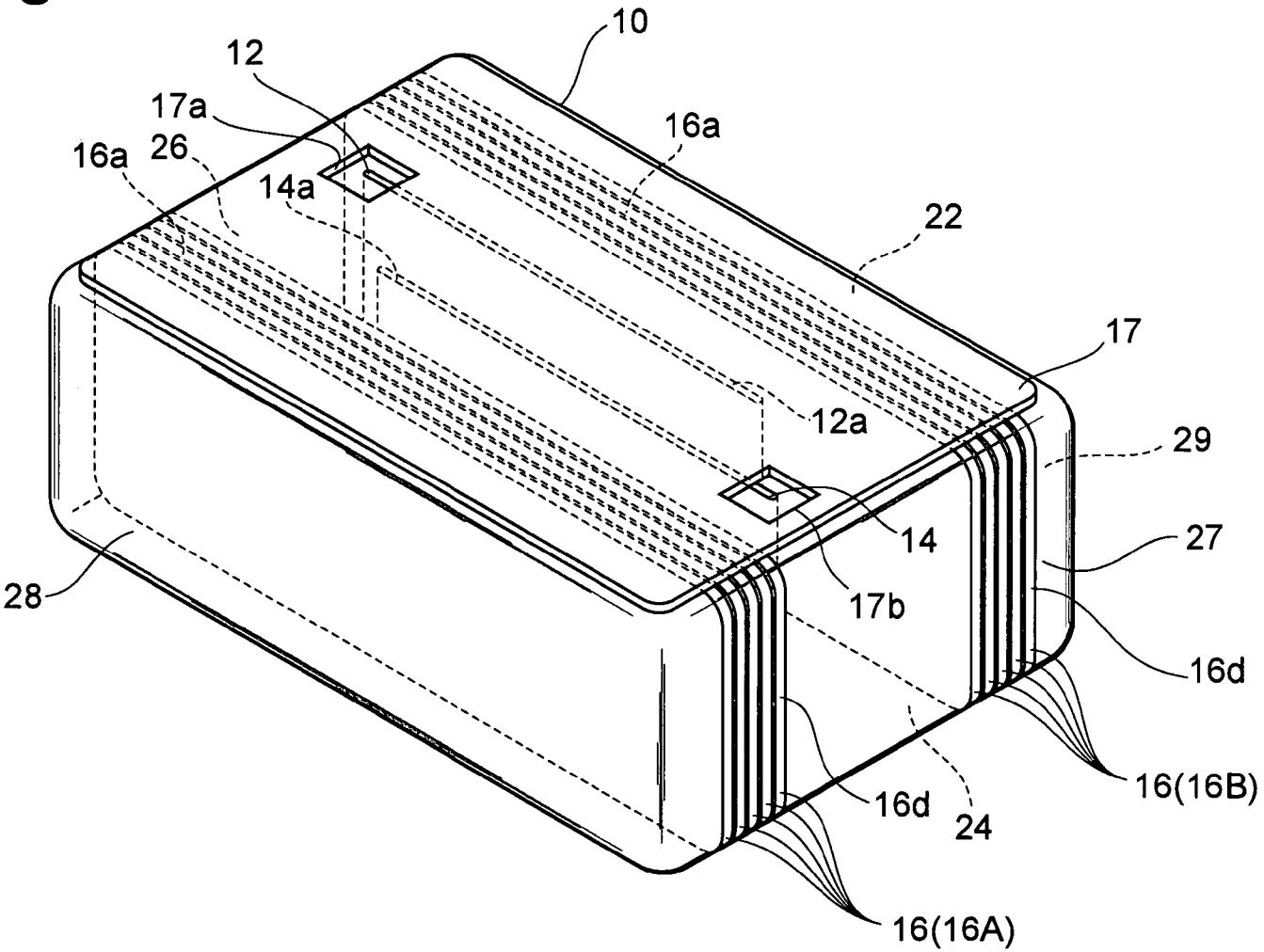
FIG. 29 is a perspective view excluding the outer electrodes and connecting terminals of the laminated chip varistor pertaining to the eleventh embodiment.

The configuration of a laminated chip varistor VII pertaining to an eleventh embodiment will be hereinafter described with reference to FIG. 24 to FIG. 29. FIG. 24 is a perspective view of a laminated chip varistor pertaining to the eleventh embodiment. FIG. 25 is a plan view of a laminated chip varistor pertaining to the eleventh embodiment. FIG. 26 is an end view along the line XXVI-XXVI of FIG. 25. FIG. 27 is an end view along the line XXVII-XXVII of FIG. 25. FIG. 28 is an exploded perspective view of a varistor body from which the laminated chip varistor pertaining to the eleventh embodiment is configured. FIG. 29 is a perspective view excluding the outer electrodes and connecting terminals of the laminated chip varistor pertaining to the eleventh embodiment.

The laminated chip varistor VII comprises a varistor body 10, a pair of first and second inner electrodes 12, 14, two groups (heat conductor groups 16A, 16B) of a plurality (five in the eleventh embodiment) of heat conductors 16, an insulating film 17, a pair of first and second outer electrodes 18, 20, and a plurality (twelve in the eleventh embodiment) of connecting terminals 21.

The varistor body 10 has a substantially rectangular parallele-piped shape having opposing first and second outer faces 22, 24, first and second side faces 26, 27 vertically opposing the first and second outer faces 22, 24, and third and fourth side faces 28, 29 vertically opposing the first and second outer faces 22, 24 and the first and second side faces. The varistor body 10 can be set to, for example, a length in the longitudinal direction of the order of 1.0 mm, a width of the order of 1.0 mm, and a thickness of the order of 0.3 mm.

The varistor body 10 is configured as a laminate obtained by a method of lamination based on sheet lamination of a plurality of varistor layers A10 to A13 (see FIG. 28) that exhibit nonlinear voltage characteristics (hereinafter referred to as "varistor characteristics"). In an actual laminated chip varistor VII the varistor layers A10 to A13 are integrated to an extent that the boundaries therebetween may be ignored. The varistor layers A10 to A13 are configured from a material that contains ZnO (zinc oxide) as its principal constituent, and a metal simplex or oxide of the rare earth metal elements, Co, Group IIb elements (B, Al, Ga, In), Si, Cr, Mo, alkali metal elements (K, Rb, Cs) and alkali earth metal elements (Mg, Ca, Sr, Ba) as an accessory constituent. The thickness of each of the varistor layers A 10 to A 13 can be set to the order of 10 μm to 100 μm.

The first and second inner electrodes 12, 14 are formed into a substantially rectangular-shaped thin plate body. End faces 12*a*, 14*a* of the first and second inner electrodes 12, 14 are drawn to the first outer face 22 to face onto the first outer face 22, and other end faces 12*b*, 14*b* are drawn to the second outer face 24 to face onto the second outer face 24. That is to say, each of the end faces 12*a*, 12*b*, 14*a*, 14*b* of the first and second inner electrodes 12, 14 are exposed on the first and second outer faces 22, 24.

The first inner electrode 12 is disposed on the varistor layer A12 nearer the first side face 26 with a predetermined interval from the first side face 26 side. The second inner electrode 14 is disposed on the varistor layer A14 nearer the second side face 27 with a predetermined interval from the second side face 27 side. For this reason, as seen from the laminating direction, the first inner electrode 12 and the second inner electrode 14 sandwich the varistor layer A10 with portions thereof opposing to each other. Accordingly, the region of the varistor layers A10 and A12 as seen from the laminating direction in which the first inner electrode 12 and the second inner electrode 14 overlap functions as a region that exhibits varistor characteristics.

The first and second inner electrodes 12, 14 contain a conductive material. While there are no particular restrictions to the conductive material contained in the first and second inner electrodes 12, 14, Ag, Pd, or an Ag—Pd alloy are preferred. The thickness adopted for the first and second inner electrodes 12, 14 may be, for example, of the order of 2 μm to 100 μm.

The heat conductor group 16A is disposed nearer the third side face 28 of the varistor body 10. The heat conductor group 16B is disposed nearer the fourth side face 29 of the varistor body 10. For this reason, the heat conductor groups 16A, 16B are provided in the varistor body 10 positioned between the first and second inner electrodes 12, 14.

The heat conductors 16 are formed into a substantially rectangular-shaped thin plate body. One end face 16*a* of the heat conductors 16, the heat conductors 16 being disposed over the entire surface of the varistor layer A11, are drawn to the first outer face 22 to face onto the first outer face 22, and the other end face 16*b* is drawn to the second outer face 24 to face onto the second outer face 24. A side face 16*c* of the heat conductors 16 is drawn to the first side face 26 to face onto the first side face 26, and the other side face 16*d* is drawn to the second side face 27 to face onto the second side face 27.

That is to say, the heat conductors 16 are formed in the varistor body 10 to extend in the direction from the first outer face 22 toward the second outer face 24 (opposing direction of the first outer face 22 and second outer face 24), to extend from the first side face 26 to the second side face 27 (opposing direction of the first side face 26 and second side face 27), and to extend in parallel with the first and second inner electrodes 12, 14. For this reason, the end faces 16*a* to 16*d* of the heat conductors 16 are exposed on each of the opposing first and second outer faces 22, 24 and first and second side faces 26, 27.

While a material of a higher thermal conductivity than the thermal conductivity of the varistor body 10 (in the first embodiment, the thermal conductivity of the ZnO which serves as the principal constituent of the varistor body 10) such as, Pd, Ag—Pd alloy or a ceramic of, for example, Aluminium nitride (AlN), BN, TiN, TaC or $Si_3N_4$ can be employed as the heat conductor 16, from the viewpoint of simplification of the manufacturing process, configuring of the heat conductor 16 from a material the same as the material of the first and second inner electrodes 12, 14 is preferred. While the thickness adopted for the heat conductor 16 may be of the order of, for example, 10 μm to 300 μm, it is preferably set larger than the thickness of the inner electrodes 12, 14.

An insulating film 17 is disposed on the first outer face 22 covering most of the first outer face 22 (see FIG. 29). The insulating film 17 comprises openings 17*a*, 17*b*. The opening 17*a* is provided in a position opposing the region of the one end face 12*a* of the first inner electrode 12 nearer the first side face 26. The opening 17*b* is provided in a position opposing the region of the one end face 14*a* of the second inner electrode 14 nearer the second side face 27. For this reason, the region of the one end face 12*a* of the first inner electrode 12 nearer the first side face 26 and the region of the one end face 14*a* of the second inner electrode 14 nearer the second side face 27 are exposed through the openings 17*a*, 17*b* and are not covered by the insulating film 17. On the other hand, the region of the one end faces 12*a*, 14*a* of the first and second inner electrodes 12, 14 other than the region exposed through the openings 17*a*, 17*b* and the one end face 16*a* of the heat conductors 16 are covered by the insulating film 17.

The insulating film 17 is configured from, for example, a bismuth oxide-based, zinc oxide-based, phosphoric acid-based or borosilicate-based glass which can be screen printed as a glass paste on the first outer face 22 in a predetermined pattern having an opening pattern corresponding to the openings 17*a*, 17*b*. The thickness of the insulating film 17 may be of the order of, for example, 1 μm to 100 μm. Apart from glass, a resin or the like can be employed for the insulating film 17.

As seen from the vertical direction to the first outer face 22, the first and second outer electrodes 18, 20 have a substantially rectangular shape extending in the opposing direction of the third and fourth side faces 28, 29. The first and second outer electrodes 18, 20 are physically and electrically connected to the end faces 12*a*, 14*a* of the first and second inner electrodes 12, 14 in corresponding pairs therewith.

More specifically, the first outer electrode 18 is formed on the insulating film 17 and the first outer face 22 exposed through the opening 17*a* of the insulating film 17. For this reason, the first outer electrode 18 is physically and electrically connected with a region nearer the first side face 26 of the one end face 12*a* of the first inner electrode 12 exposed on the first outer surface 22 and not covered (opposing the opening 17*a* of the insulating film 17) by the insulating film 17 to cover this region. Because there is no opening other than the opening 17*a* provided in the insulating film 17 in the direction in which the first outer electrode 18 extends, the first outer electrode 18 is not physically and electrically connected with the one end face 14*a* of the second inner electrode 14 and one end face 16*a* of the heat conductors 16 exposed on the first outer face 22.

The second outer electrode 20 is formed on the insulating film 17 and the first outer face 22 exposed through the opening 17*b*. For this reason, the second outer electrode 20 is physically and electrically connected with a region nearer the second side face 27 of the one end face 14*a* of the second inner electrode 14 exposed on the first outer surface 22 and not covered by the insulating film 17 (corresponding to the opening 17*b* of the insulating film 17) to cover this region. Because there is no opening other than the opening 17*b* provided in the insulating film 17 in the direction in which the second outer electrode 20 extends, the second outer electrode 20 is not physically and electrically connected with the one end face 12*a* of the first inner electrode 12 and one end face 16*a* of the heat conductors 16 exposed on the first outer face 22.

As seen from the vertical direction to the first outer face 22, the connecting terminals 21 have a substantially square shape and are formed on the insulating film 17 without physical connection therebetween. As seen from the vertical direction to the first outer face 22, the connecting terminals 21 are disposed on the insulating film 17 to cover a predetermined region of the one end face 12*a* of the first inner electrode 12, a predetermined region of the one end face 14*a* of the second inner electrode 14, and a predetermined one end face 16*a* of the heat conductors 16, and are thermally connected therewith.

More specifically, as seen from the vertical direction to the first outer face 22, the three connecting terminals 21 (connecting terminal group 21A) of the connecting terminals 21 disposed nearer the third side face 28 along the opposing direction of the first and second side faces 26, 27 are disposed on the insulating film 17 to cover predetermined regions of the one end face 16*a* of the heat conductors 16 from which the heat conductor group 16A is configured, and are thermally connected with the heat conductors 16 from which the heat conductor group 16A is configured. As seen from the vertical direction to the first outer face 22, the three connecting terminals 21 (connecting terminal group 21B) of the connecting terminals 21 disposed nearer the fourth side face 29 along the opposing direction of the first and second side faces 26, 27 are disposed on the insulating film 17 to cover predetermined regions of the one end face 16*a* of the heat conductors 16 from which the heat conductor group 16B is configured, and are thermally connected with the heat conductors 16 from which the heat conductor group 16B is configured.

The first and second outer electrodes 18, 20 connecting terminals 21 can be formed by, for example, a printing method or a plating method. If the printing method is employed, a conductive paste obtained by mixing of an organic binder and organic solvent in a metal powder of which the principal constituent is Au particles or Pt particles is prepared, and this conductive paste is printed on the varistor body 10 and this printed conductive paste is baked or sintered. The plating method is based on deposition of Au or Pt using a method of vacuum plating (vacuum deposition, spluttering method, ion plating method or the like).

Figure 30:
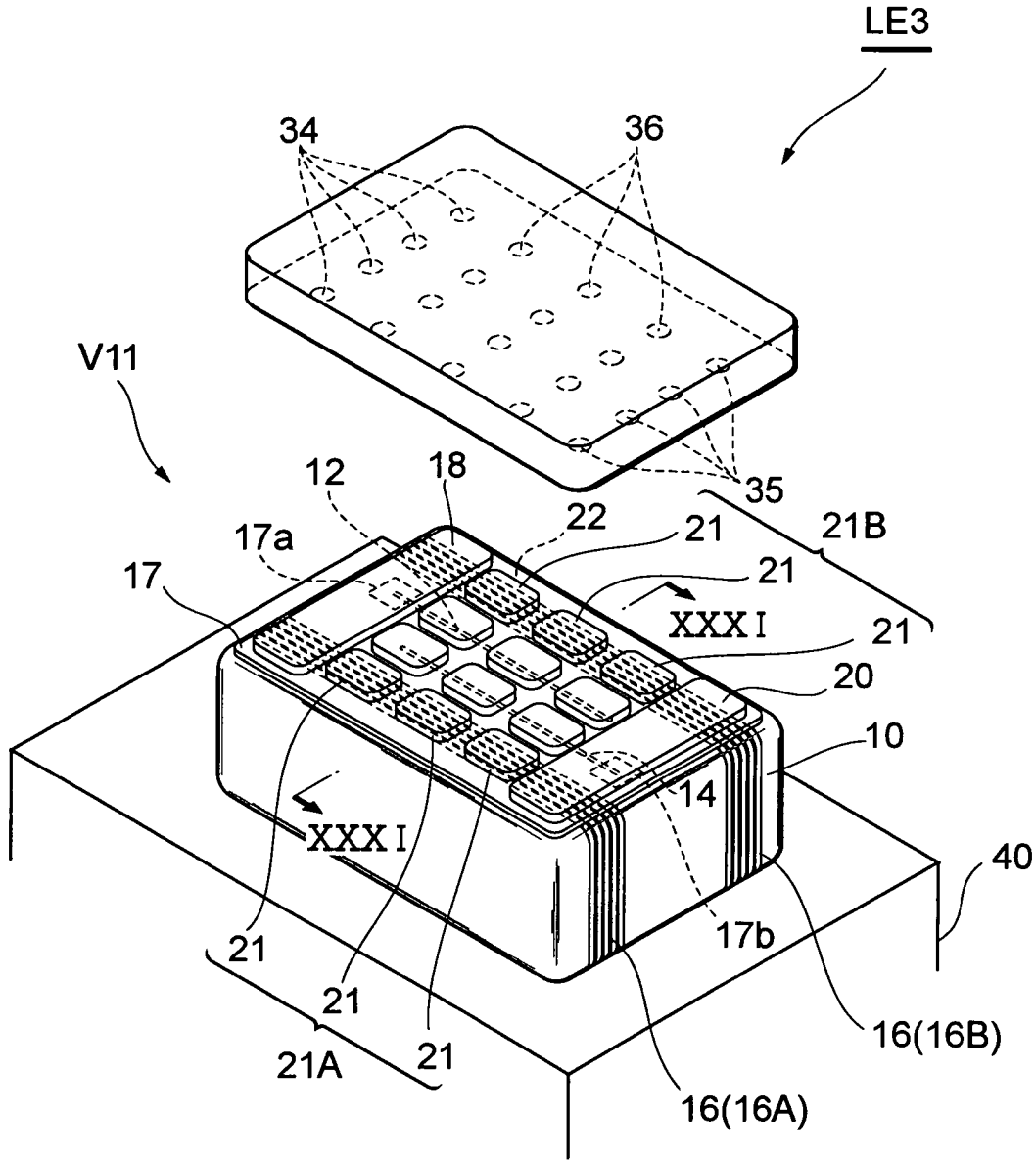
FIG. 30 is an exploded perspective view of a light emitting device in which the laminated chip varistor pertaining to the eleventh embodiment is employed.
Figure 31:
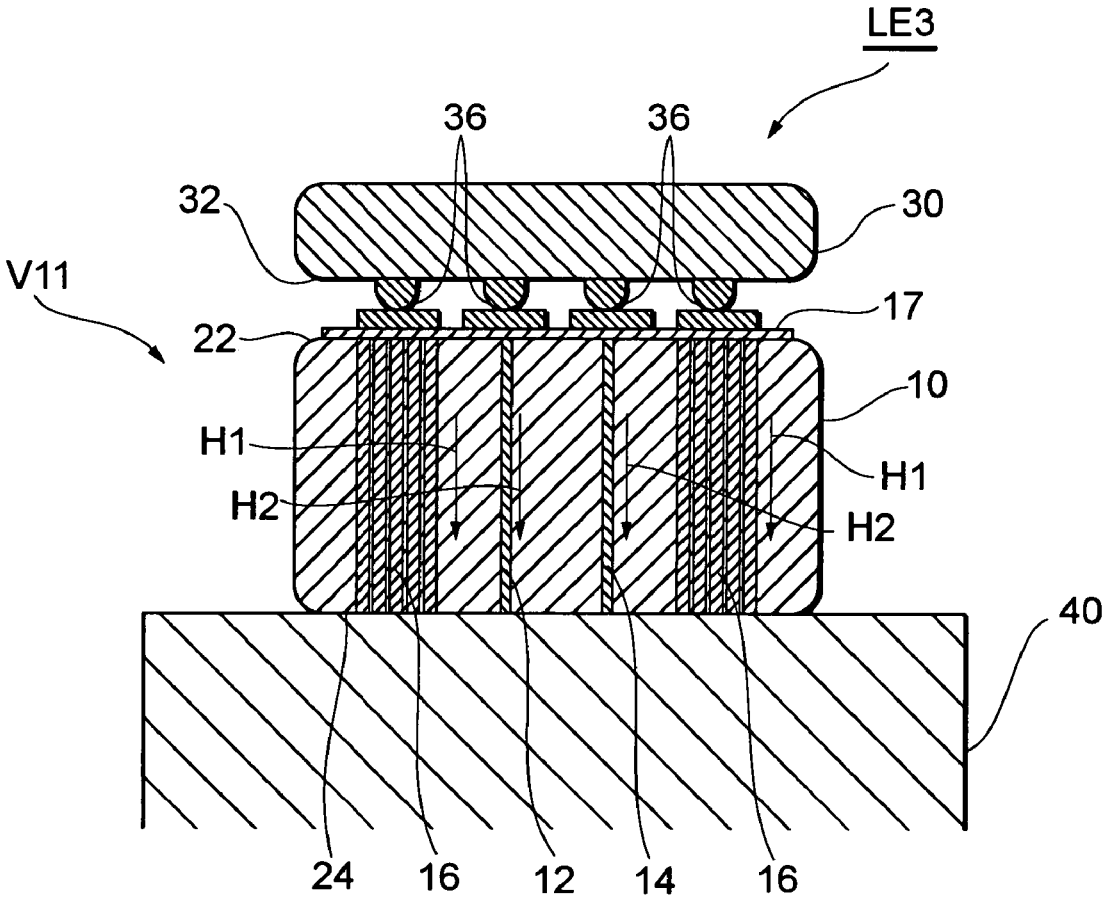
FIG. 31 is an end view along the line XXXI-XXXI of FIG. 30.

A light emitting device LE3 comprising the laminated chip varistor V11 of the configuration described above has connection with a semiconductor light emitting element 30 will be hereinafter described with reference to FIG. 30 and FIG. 31. FIG. 30 is an exploded perspective view of a light emitting device in which the laminated chip varistor pertaining to the eleventh embodiment is employed. FIG. 31 is a diagram of the end face along the line XXXI-XXXI of FIG. 30.

The light emitting device LE3 comprises the laminated chip varistor VII and a substrate 40 on which the semiconductor light emitting element 30 and the laminated chip varistor V11 are mounted.

The semiconductor light emitting element 30 is a LED (Light Emitting Diode) of, for example, a GaN (gallium nitride)-based semiconductor. The semiconductor light emitting element 30 emits light in a light emitting region subsequent to the flow of an electric current produced by a predetermined voltage applied between an anode electrode and cathode electrode not shown in the diagram.

In the semiconductor light emitting element 30, first to third bump electrodes 34 to 36 are formed in plurality in an opposing face 32 opposing the first outer face 22 of the varistor body 10 of the laminated chip varistor Vii. The first bump electrodes 34 are connected with an anode electrode not shown in the diagram and disposed in a position opposing the first outer electrode 18 of the semiconductor light emitting element 30. The second bump electrodes 35 are connected with a cathode electrode not shown in the diagram and disposed in a position opposing the second outer electrode 20 of the semiconductor light emitting element 30. These first and second bump electrodes 34, 35 are physically and electrically connected to the first and second outer electrodes 18, 20 by solder reflow. Because the semiconductor light emitting element 30 is connected to the first and second outer electrodes 18, 20 by the plurality of first and second first bump electrodes 34, 35 in this way, the bonding strength between the semiconductor light emitting element 30 and the laminated chip varistor Vii is improved.

The first and second outer electrodes 18, 20 are also electrically connected to the corresponding bump electrode 34, 35. For this reason, a varistor configured from the first inner electrode 12, second inner electrode 14, and region in which the first and second inner electrodes 12, 14 overlap in the varistor layers A10, A12 is connected in parallel with the semiconductor light emitting element 30. Accordingly, the semiconductor light emitting element 30 can be protected from ESD (Electro Static Discharge) surges by the laminated chip varistor V11. The first and second outer electrodes 18, 20 of the laminated chip varistor V11 function as input/output terminal electrodes of the laminated chip varistor V11 at this time.

The bump electrodes 36 are connected to a main body section that constitutes a non-electrode section of the semiconductor light emitting element 30 and are disposed in a position to form opposing pairs with the connecting terminals 21. The bump electrodes 36 are physically and thermally connected with the connecting terminals 21 by solder reflow. For this reason, the bump electrodes 36 transfer the heat generated by the semiconductor light emitting element 30 to the first and second inner electrodes 12, 14 and the heat conductors 16.

In the eleventh embodiment described above, the heat conductors 16 are formed in the interior of the varistor body 10 extending in a direction from the first outer face 22 toward the second outer face 24 and extending in parallel with the first and second inner electrodes 12, 14. The thermal conductivity of the material of the heat conductors 16 is higher than the thermal conductivity of the varistor body 10 (in the eleventh embodiment, thermal conductivity of ZnO which serves as the principal constituent of the varistor body 10). In addition, the one end face 16*a* of the heat conductors 16 is exposed on the first outer face 22, and the other end face 16*b* of the heat conductors 16 is exposed on the second outer face 24. For this reason, the heat generated by the semiconductor light emitting element 30 is transferred from the first outer face 22 toward the second outer face 24 along the heat conductors 16 by way of the insulating film 17, connecting terminals 21 and bump electrodes 36 which physically and thermally connect the one end face 16*a* of the heat conductors 16 with the semiconductor light emitting element 30 (see the arrow H1 of FIG. 31). As a result, the heat of the semiconductor light emitting element 30 is able to be effectively dissipated to the substrate 40 by the laminated chip varistor V11.

In addition, the heat conductors 16 of the eleventh embodiment are disposed on the entire surface of the varistor layer A11. For this reason, the need for patterning when the heat conductors 16 are formed on the varistor layer A11 is eliminated. As a result, the manufacturing process of the laminated chip varistor V11 can be simplified. In addition, because a plurality of laminated chip varistors V11 are normally manufactured by cutting of a laminate obtained by lamination of varistor layers A10 to A13 in which the plurality of heat conductors 16 and plurality of first and second inner electrodes 12, 14 have been patterned, the need to consider the position of the varistor layer A11 during lamination is eliminated by disposing the heat conductors 16 on the entire surface of the varistor layer A11 in this way. Accordingly, this arrangement is suitable for bulk manufacture of the laminated chip varistor V11.

In addition, in the eleventh embodiment, excluding the region of the one end face 12*a* of the first inner electrode 12 nearer the first side face 26 and the region of the one end face 14*a* of the second inner electrode 14 nearer the second side face 27, the end faces 12*a*, 14*a* of the first and second inner electrodes 12, 14 and end face 16*a* of the heat conductors 16 are covered by the insulating film 17. For this reason, the electrical connection of the heat conductors 16 with the first and second outer electrodes 18, 20 is removed. As a result, even if the one end face 16*a* of the heat conductors 16 is exposed on the first outer face 22, the degree of freedom of the patterning shape of the first and second outer electrodes 18, 20 can be ensured.

Twelfth Embodiment

Figure 32:
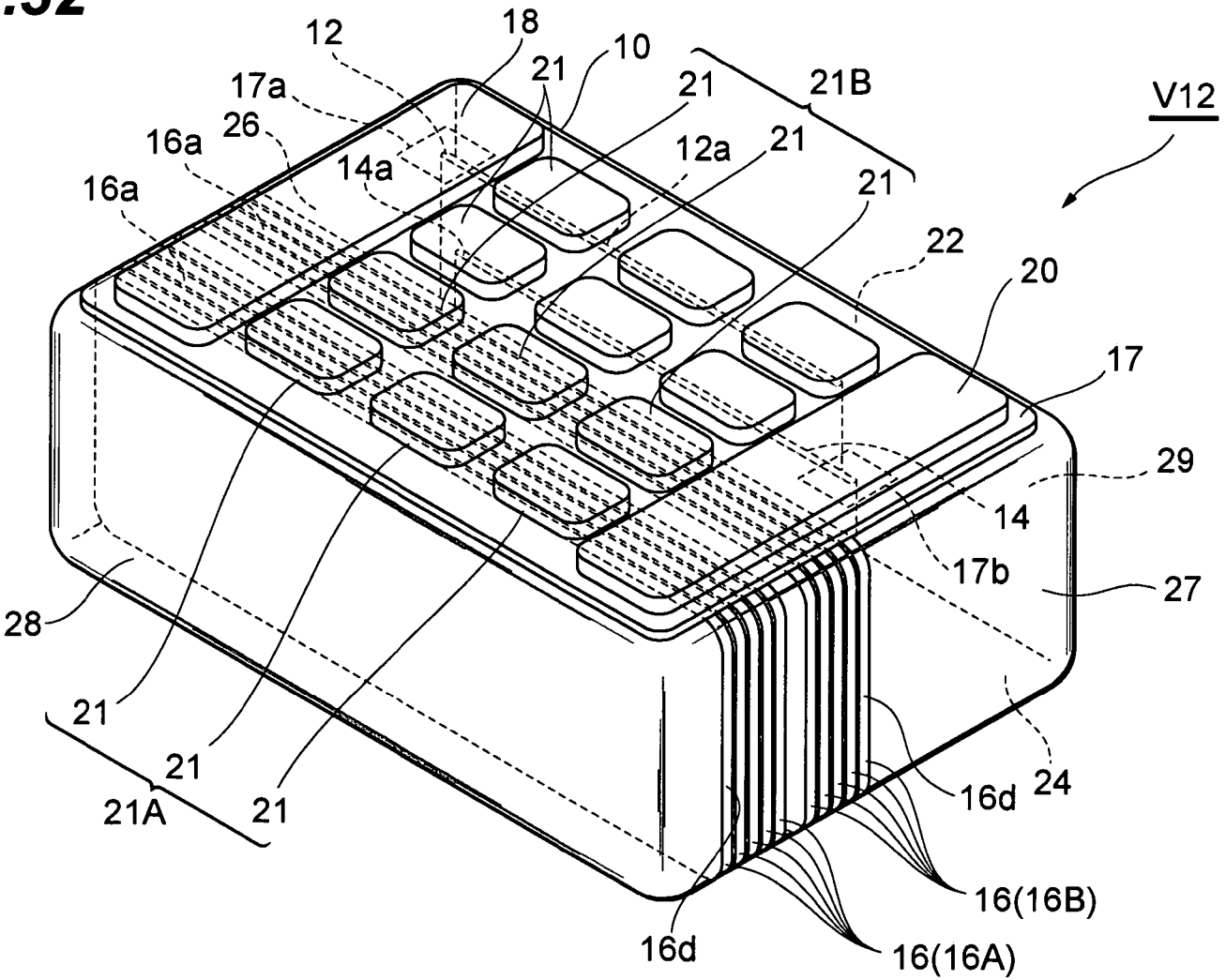
FIG. 32 is a perspective view of a varistor element pertaining to a twelfth embodiment.
Figure 33:
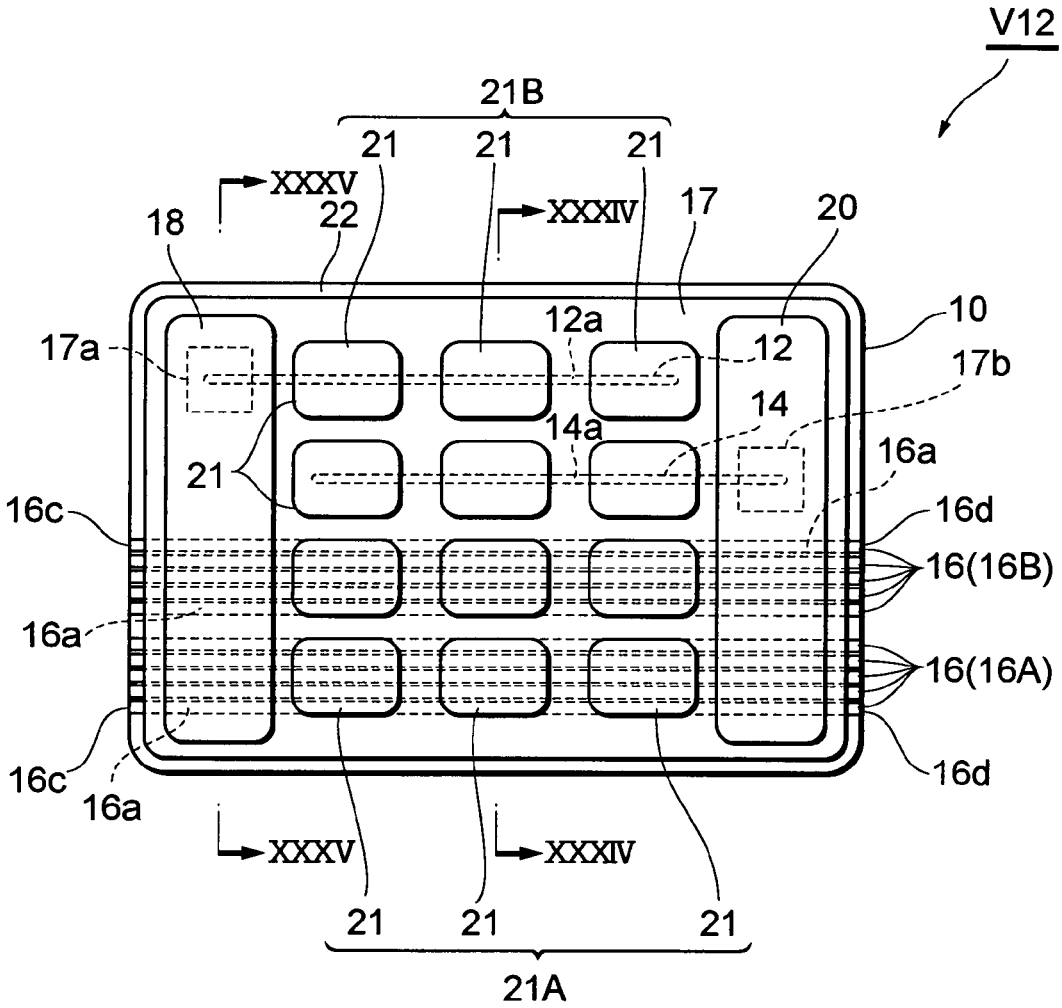
FIG. 33 is a plan view of the varistor element pertaining to the twelfth embodiment.
Figure 34:
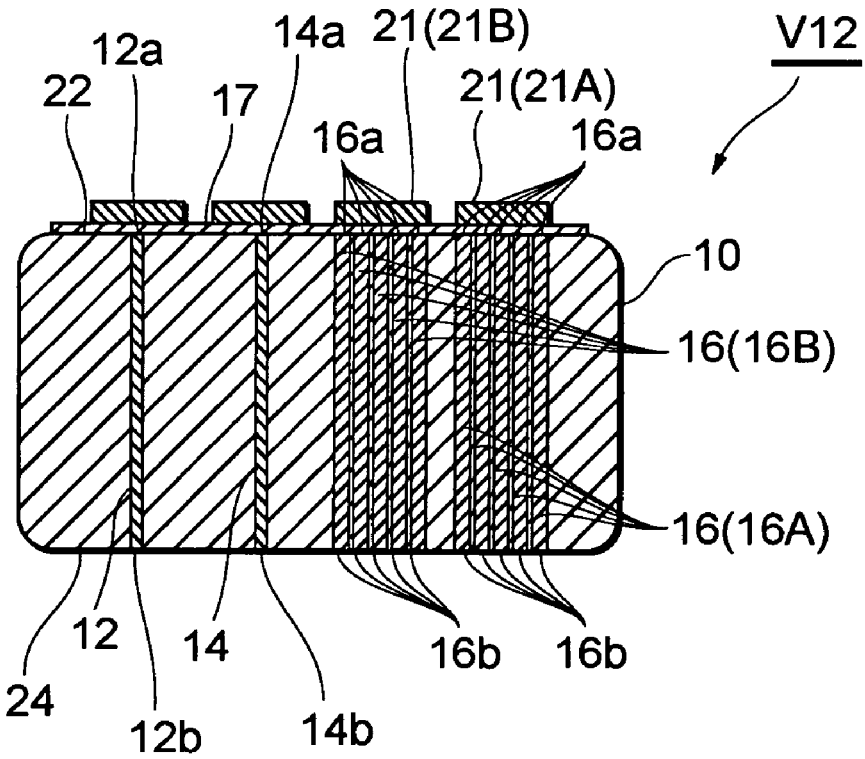
FIG. 34 is an end view along the line XXXIV-XXXIV of FIG. 33.
Figure 35:
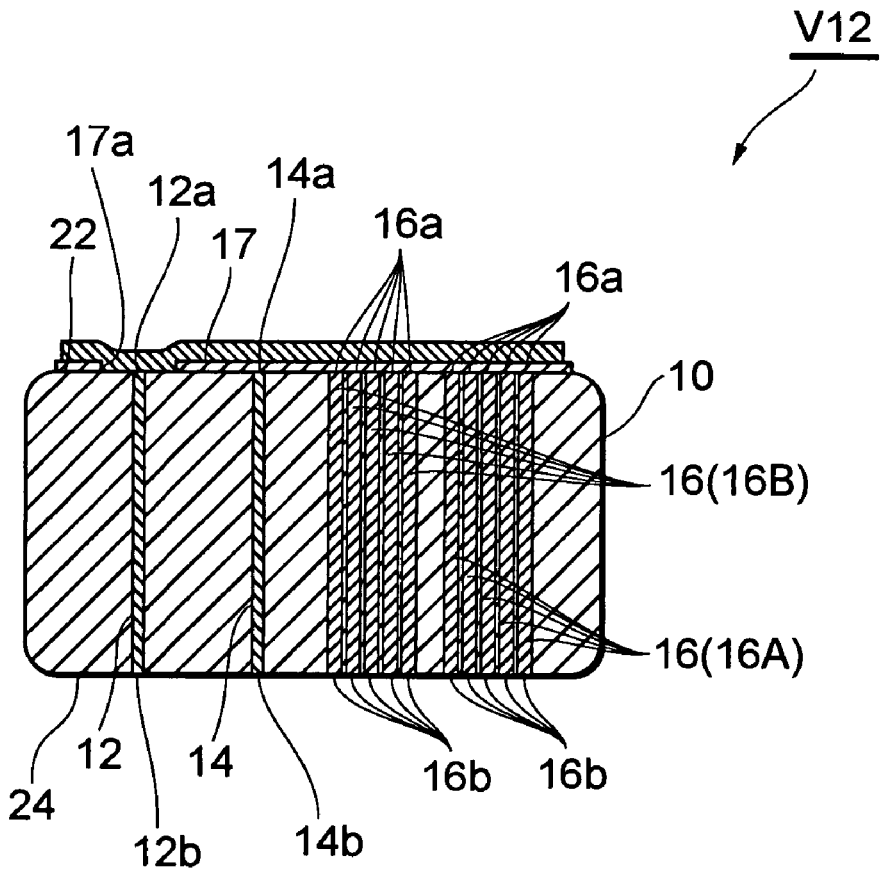
FIG. 35 is an end view along the line XXXV-XXXV of FIG. 33.

The configuration of the laminated chip varistor V12 pertaining to a twelfth embodiment will be hereinafter described with reference to FIG. 32 to FIG. 35. FIG. 32 is a perspective view of the varistor element pertaining to the twelfth embodiment. FIG. 33 is a plan view of the varistor element pertaining to the twelfth embodiment. FIG. 34 is an end view along the line XXXIV-XXXIV of FIG. 33. FIG. 35 is an end view along the line XXXV-XXXV of FIG. 33. The laminated chip varistor V12 pertaining to the twelfth embodiment differs from the laminated chip varistor VII pertaining to the eleventh embodiment described above in the arrangement of the first and second inner electrodes 12, 14 and the arrangement of the heat conductors 16.

First and second inner electrodes 12, 14 and two groups (heat conductor groups 16A, 16B) of five heat conductors 16 are provided in the varistor body 10 of the laminated chip varistor V12 pertaining to the twelfth embodiment. The first and second inner electrodes 12, 14 are disposed nearer the fourth side face 29 of the varistor body 10, the first inner electrode 12 being disposed on the outer side of the second inner electrode 14. The heat conductor groups 16A, 16B are disposed nearer the third side face 28 of the varistor body 10, the heat conductor group 16A being disposed on the outer side of the heat conductor group 16B.

As seen from the vertical direction from the first outer face 22, three connecting terminals 21 (connecting terminal group 21A) of the connecting terminals 21 disposed nearest the third side face 28 along the opposing direction of the first and second side faces 26, 27 are disposed on an insulating film 17 to cover predetermined regions 16*a* of the heat conductors 16 from which the heat conductor group 16A is configured, and are thermally connected with the heat conductors 16 from which the heat conductor group 16A is configured. Three connecting terminals 21 (connecting terminal group 21B) of the connecting terminals 21 disposed nearer the third side face 28 and disposed nearer the fourth side face 29 from the connecting terminal group 21A along the opposing direction of the first and second side faces 26, 27 are disposed on the insulating film 17 to cover predetermined regions 16*a* of the heat conductors 16 from which the heat conductor group 16B is configured, and are thermally connected with the heat conductors 16 from which the heat conductor group 16B is configured.

The laminated chip varistor V12 pertaining to the twelfth embodiment described above affords the same action and effect as the laminated chip varistor V11 pertaining to the eleventh embodiment.

Thirteenth Embodiment

Figure 36:
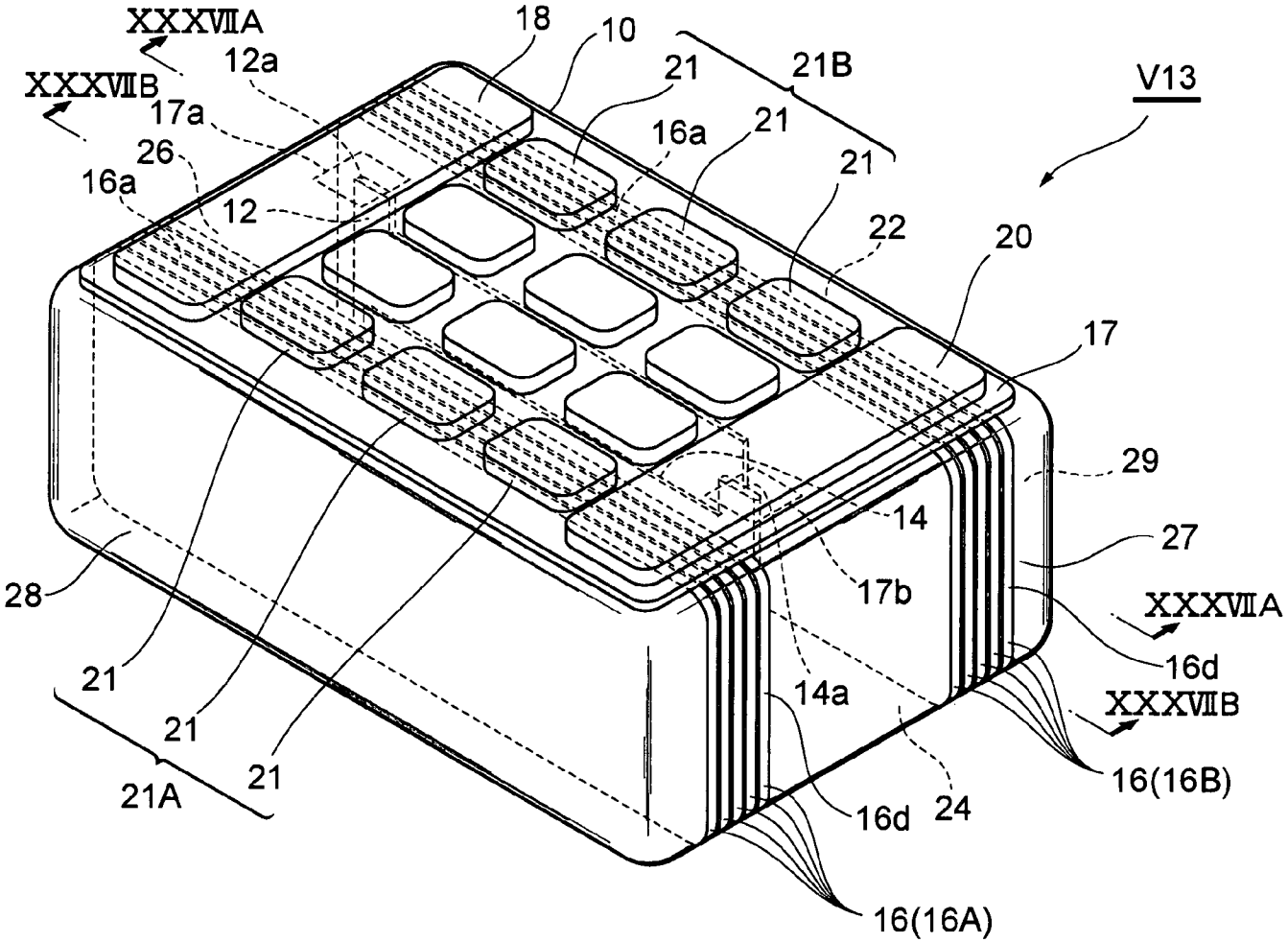
FIG. 36 is a perspective view of a varistor element pertaining to a thirteenth embodiment.
Figure 37:
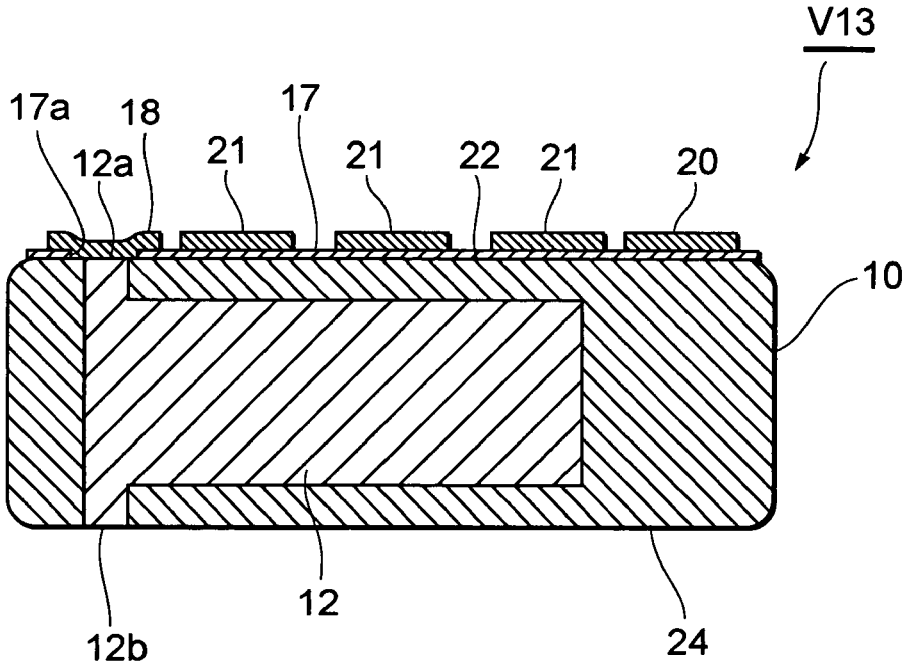
FIG. 37 is (a): an end view along the line XXXVIIA-XXXVIIA of FIG. 36 and (b): an end view along the line XXXVIIB-XXXVIIB of FIG. 36.
Figure 37:
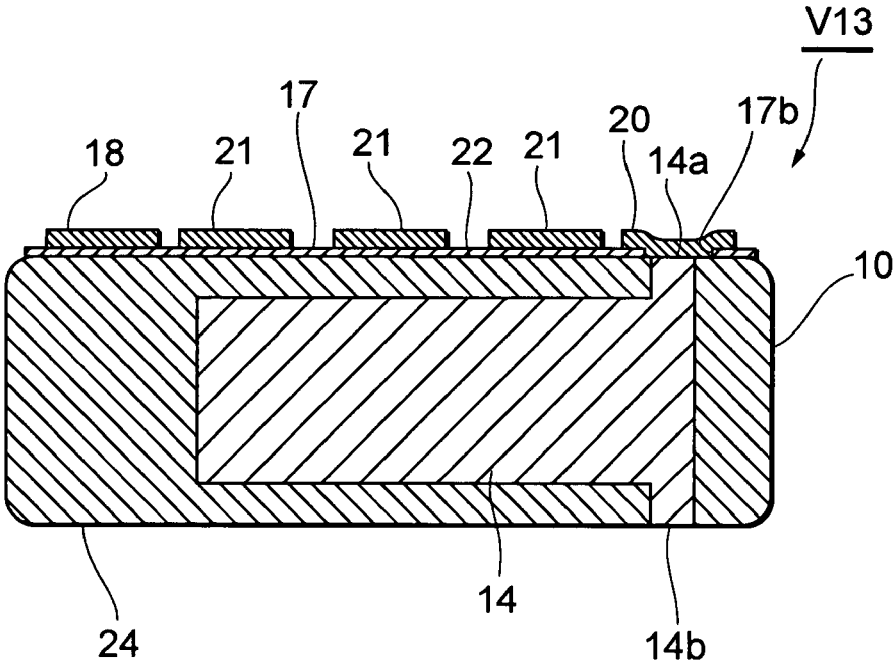

A laminated chip varistor V13 pertaining to a thirteenth embodiment will be hereinafter described with reference to FIG. 36 and FIG. 37. FIG. 36 is a perspective view of the varistor element pertaining to the thirteenth embodiment. FIG. 37 is (a): an end view along the line XXXVIIA-XXXVIIA of FIG. 36 and (b): an end view along the line XXXVIIB-XXXVIIB of FIG. 36. The laminated chip varistor V13 pertaining to the thirteenth embodiment differs from the laminated chip varistor VII pertaining to the eleventh embodiment in the shape of the heat conductors 16.

First and second inner electrodes 12, 14 and two groups of five heat conductors 16 (heat conductor groups 16A, 16B) are provided in the varistor body 10 of the laminated chip varistor V13 pertaining to the thirteenth embodiment. The first and second inner electrodes 12, 14 are formed into a substantially T-shaped thin plate body. End faces 12*a*, 14*a* of one tip-end section forming a substantially T-shape of the first and second inner electrodes 12, 14 are drawn to the first outer face 22 facing the first outer face 22 and are exposed on the first outer face 22, and other end faces 12*b*, 14*b* of the other tip-end section forming a substantially T-shape are drawn to the second outer face 24 to face onto the second outer face 24 and are exposed on the second outer face 24. First and second outer electrodes 18, 20 are formed on the first outer face 22 so as to have physical and electrical connection with the end faces 12*a*, 14*a* of the first and second inner electrodes 12, 14 exposed on the first outer face 22.

The laminated chip varistor V13 pertaining to the thirteenth embodiment described above affords the same action and effect as the laminated chip varistor V11 pertaining to the eleventh embodiment.

While preferred embodiments of the present invention are described in detail above, the present invention should not be regarded as being limited to these embodiments. For example, the first outer face 22 and second outer face 24 need not be opposing to each other. By arrangement of the heat conductors 16 to extend from the first outer face 22 in the direction toward the second outer face 24 in this case, the heat of the semiconductor light emitting element 30 can be efficiently transferred from the first outer face 22 toward the second outer face 24 along the heat conductors 16.

In addition, the end faces 16*a*, 16*b* of the heat conductors 16 of the laminated chip varistors V1 to V10 pertaining to the first to tenth embodiments need not be exposed from the opposing first and second outer faces 22, 24. At this time, a heat conducting passage is formed from the heat conductors 16 and a portion of varistor body 10, and the heat from the semiconductor light emitting element 30 is transferred form the first outer face 22 toward the second outer face 24 along this heat conducting passage.

In addition, in addition to the method of sheet-laminate processing, a method of print lamination can be employed as the method for forming the varistor body 10 of the laminated chip varistors V1 to V13.

In addition, as the method for forming the heat conductors 16 in the varistor body 10 of the laminated chip varistors V1 to V10 pertaining to the first to tenth embodiments, a method in which, following forming of the varistor body 10, through holes are formed in the varistor body 10 passing through the first and second outer faces and these through holes are packed with the heat conductors 16 may be employed.

In addition, the laminate chip varistors pertaining to the present invention may be connected to electronic elements that generate heat during the operation thereof, instead of the semiconductor light emitting element 30.

In addition, while the heat conductors 16 from which the heat conductor groups 16A, 16B are configured are provided in five layers in the laminated chip varistors V8 to V10 pertaining to the eighth to tenth embodiments, this is not limited thereto, and the heat conductors 16 from which the heat conductor groups 16A, 16B are configured may be provided in a single layer or two or more layers, and the number of the heat conductors 16 from which the heat conductor group 16A is configured and the number of heat conductors 16 from which the heat conductor group 16B is configured may differ.

In addition, while the heat conductors 16 from which the heat conductor groups 16A, 16B are configured are provided in five layers in the laminated chip varistors V11 to V13 pertaining to the eleventh to thirteenth embodiments, this is not limited thereto, and the heat conductors 16 from which the heat conductor groups 16A, 16B are configured may be provided in a single layer or two or more layers, and the number of the heat conductors 16 from which the heat conductor group 16A is configured and the number of heat conductors 16 from which the heat conductor group 16B is configured may differ.

From the invention thus described it is obvious that the invention may be varied in many ways. Such variations should not be regarded as a departure from the spirit and scope of the invention, and all such modifications as obvious to one skilled in the art are intended for inclusion within the scope of the following claims.

What is claimed is:

1. A varistor element comprising:

a varistor body having first and second outer faces;

first and second inner electrodes disposed in said varistor body so that at least portions thereof are opposing to each other;

a first outer electrode electrically connected to said first inner electrode and formed on said first outer face; and a second outer electrode electrically connected to said second inner electrode and formed on said first outer face and, wherein a heat-conducting passage is formed through said varistor body from said first outer face toward said second outer face.

2. The varistor element according to claim 1, wherein said heat-conducting passage extends in parallel with said first and second inner electrodes.

3. The varistor element according to claim 2, wherein said first outer face and said second outer face are opposing to each other, and said heat-conducting passage extends in an opposing direction of said first and second outer faces.

4. The varistor element according to claim 1, wherein said heat-conducting passage contains at least a heat conductor having a thermal conductivity higher than a thermal conductivity of said varistor body.

5. The varistor element according to claim 4, wherein one end of said heat conductor is exposed on said first outer face, and the other end thereof is exposed on said second outer face.

6. The varistor element according to claim 4, wherein said heat conductor is configured from a material the same as the material of said first and second inner electrodes.

7. A varistor element comprising:

a varistor body having first and second outer faces;

first and second inner electrodes disposed in said varistor body so that at least portions thereof are opposing to each other;

a first outer electrode electrically connected to said first inner electrode and formed on said first outer face and;

a second outer electrode electrically connected to said second inner electrode and formed on said first outer face and;

a heat conductor which is disposed to pass through said varistor body from said first outer face toward said second outer face and one end of which is exposed on said first outer face; and an insulating film disposed on said first outer face to cover at least one end of said heat conductor exposed on said first outer face.

8. The varistor element according to claim 7, wherein said heat conductor extends in parallel with said first and second inner electrodes.

9. The varistor element according to claim 8, wherein said first outer face and said second outer face are opposing to each other, and said heat conductor extends in an opposing direction of said first and second outer faces.

10. The varistor element according to claim 9, wherein said varistor body has an opposing first side face and second side face that extend to couple said first outer face and said second outer face, and said heat conductor extends in an opposing direction of said first and second side faces.

11. The varistor element according to claim 10, wherein said heat conductor has a section exposed on said first and second side faces.

12. The varistor element according to claim 7, wherein the other end of said heat conductor is exposed on said second outer face.

13. The varistor element according to claim 7, wherein a width of said heat conductor in an opposing direction of said first and second inner electrodes is greater than a width of the first and second inner electrodes in an opposing direction of said first and second inner electrodes.

14. The varistor element according to claim 7, wherein a thermal conductivity of said heat conductor is higher than a thermal conductivity of said varistor body.

15. The varistor element according to claim 7, wherein said heat conductor is configured from a material the same as the material of said first and second inner electrodes.

* * * * *